US012053669B1

(12) United States Patent
Holland

(10) Patent No.: US 12,053,669 B1
(45) Date of Patent: Aug. 6, 2024

(54) MULTI-PURPOSE EXERCISE DEVICE

(71) Applicant: Thomas P. Holland, Darien, CT (US)

(72) Inventor: Thomas P. Holland, Darien, CT (US)

( * ) Notice: Subject to any disclaimer, the term of this patent is extended or adjusted under 35 U.S.C. 154(b) by 0 days.

(21) Appl. No.: 18/348,197

(22) Filed: Jul. 6, 2023

(51) Int. Cl.
*A63B 22/20* (2006.01)
*A63B 21/072* (2006.01)

(52) U.S. Cl.
CPC ..... *A63B 22/20* (2013.01); *A63B 21/072* (2013.01)

(58) Field of Classification Search
CPC ..... A63B 22/20; A63B 22/203; A63B 21/072; A63B 21/0726
See application file for complete search history.

(56) References Cited

U.S. PATENT DOCUMENTS 6,132,282 A * 10/2000 Camp ..... A63H 33/003 446/124
2001/0001094 A1* 5/2001 Panes ..... A63B 65/06 482/109
2015/0190672 A1* 7/2015 Rost ..... A63B 21/00065 482/141
2015/0321041 A1* 11/2015 Stephan ..... A63B 26/003 482/132
2017/0266478 A1* 9/2017 Black ..... A63B 22/20
2023/0173324 A1* 6/2023 Jackson ..... A63B 22/20 482/108

* cited by examiner

*Primary Examiner* — Zachary T Moore
(74) *Attorney, Agent, or Firm* — Farber LLC

(57) ABSTRACT

A multi-purpose exercise device has first and second hemispherical bodies each having a planar, circular face and a hemispherical dome extending from the face, and having a bore extending through the body. A rod is configured to be received within the bore of each body and the bodies have a configuration forming a spherical assembly wherein the rod extends through the bore of each body forming an axle. Handles connect to the rod on opposing sides of the spherical assembly, and are operable to receive a substantial downward force thereon. The handles prevent axial movement of each body relative to the rod. The spherical assembly is operable to roll on a floor surface with a substantial downward force applied to the handles. The bodies have a disassembled configuration, wherein the rod is removed from the assembly.

20 Claims, 37 Drawing Sheets

MULTI-PURPOSE EXERCISE DEVICE

FIELD OF THE INVENTION

The invention pertains to the field of exercise devices, and in particular exercise devices with multiple configurations.

BACKGROUND OF THE INVENTION

Physical fitness and exercise play integral roles in maintaining a healthy lifestyle. Various exercise devices and equipment have been developed to meet the diverse needs and preferences of individuals seeking to improve their fitness levels. However, many existing exercise devices are single-purpose or limited in their range of exercises, requiring users to invest in and store multiple different exercise devices to achieve a comprehensive workout.

Current multi-purpose exercise devices on the market often lack the adaptability and convenience required to address these issues effectively. While some devices offer adjustable resistance or a limited number of exercise variations, they may still fall short of providing users with a comprehensive and space-efficient solution.

Therefore, there is a need for an improved multi-purpose exercise device that overcomes the limitations of existing equipment. Such a device should provide users with the ability to arrange its parts in various configurations, thereby enabling a wide range of exercises and workout routines.

SUMMARY OF THE INVENTION

The present invention addresses the above concerns by providing a multi-purpose exercise device that combines versatility, convenience, and cost-effectiveness. With the ability to arrange and configure its interchangeable parts in various setups, the device allows users to engage in a multitude of exercises. This eliminates or reduces the need of purchasing multiple exercise devices and minimizes the storage space required.

By consolidating multiple exercises into a single device, the present invention offers users the convenience of a compact and lightweight solution that can be easily stored, transported, and used in various settings. Whether in a home gym, fitness studio, or during travel, the multi-purpose exercise device provides users with a comprehensive workout experience without the limitations associated with traditional exercise equipment.

The multi-purpose exercise device presented herein includes first and second substantially identical hemispherical bodies, each having a face which is substantially planar and substantially circular, and a dome extending from the face, which is substantially hemispherical and has an apex. A bore extends through the body from the face to the apex of the dome, and is coaxial with an axis of the body. Each body is substantially rigid and is operable to support a substantial human weight applied to the face or the dome without substantial deformation. A rod is configured to be selectively received within the bore of each body.

The exercise device has an assembled configuration comprising the face of the first body abutting the face of the second body, and the axis of the first body being substantially aligned (e.g., colinear) with the axis of the second body, forming a substantially spherical assembly. The rod is disposed within the bores of the first and second bodies in the spherical assembly, and forms an axle for the spherical assembly. First and second stops connected to the rod closely adjacent opposing sides of the spherical assembly prevent substantial axial movement of each body relative to the longitudinal axis of the rod such that the first and second bodies are confined in the spherical assembly. At least one of the first and second stops can be disconnected from the rod to permit removal of the bodies from the rod for disassembly of the spherical assembly.

The exercise device also has a disassembled configuration wherein each body is separated from the rod can be used as an exercise support in either a face-down or face-up orientation.

Other features and benefits of the inventive exercise device are described herein below.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE PREFERRED EMBODIMENTS

Figure 1:
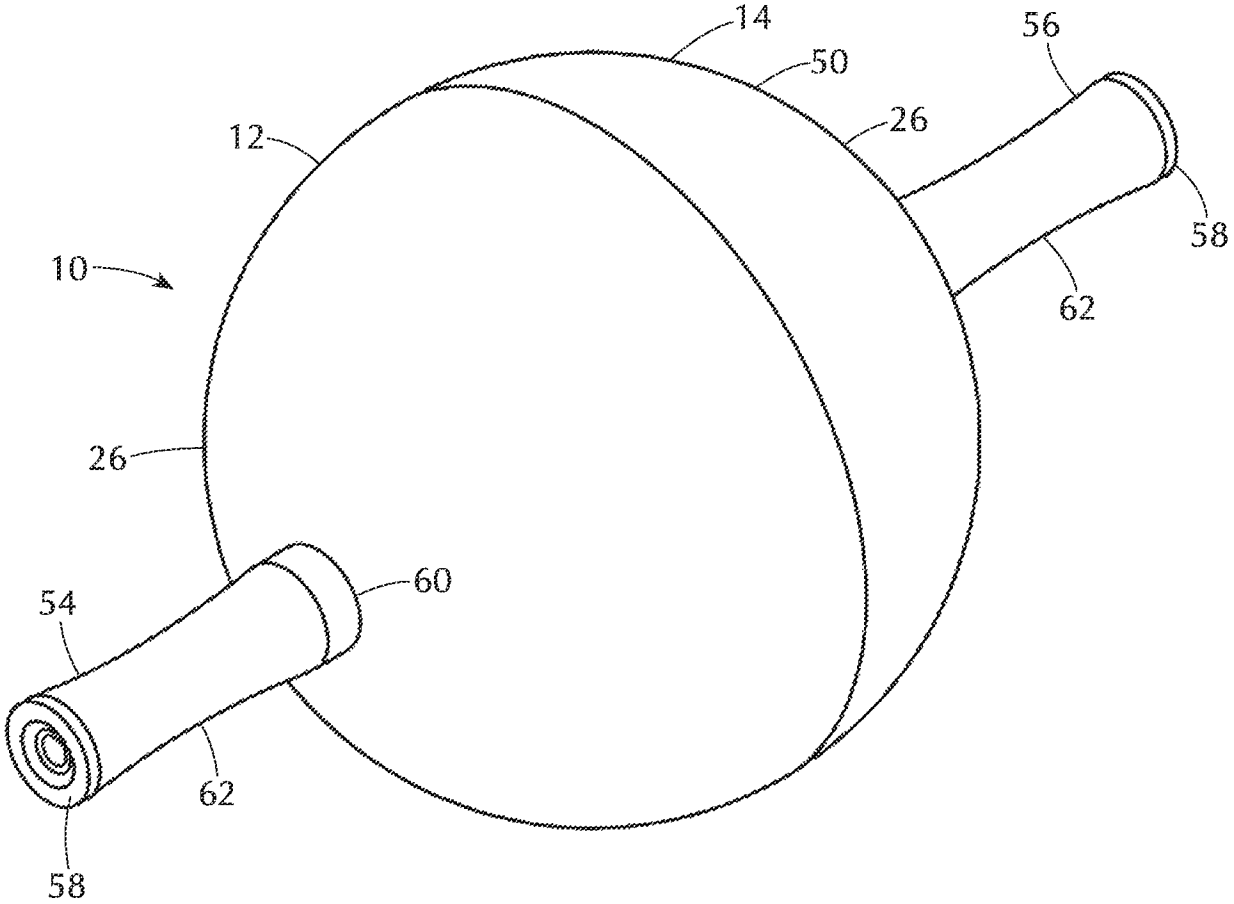
FIG. 1 is a perspective view of a first preferred embodiment of the exercise device.
Figure 2:
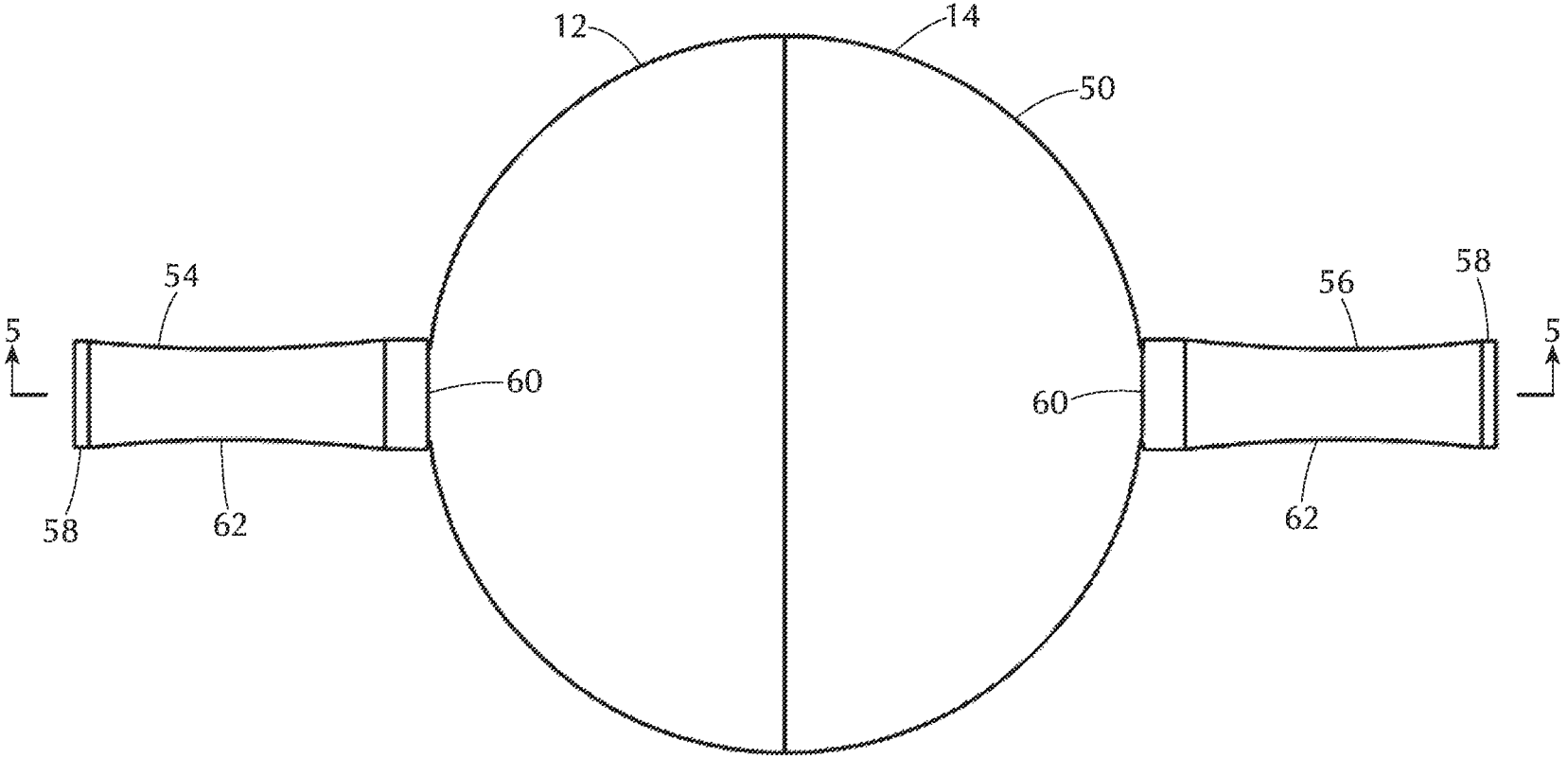
FIG. 2 side elevation view of the exercise device of FIG. 1.
Figure 3:
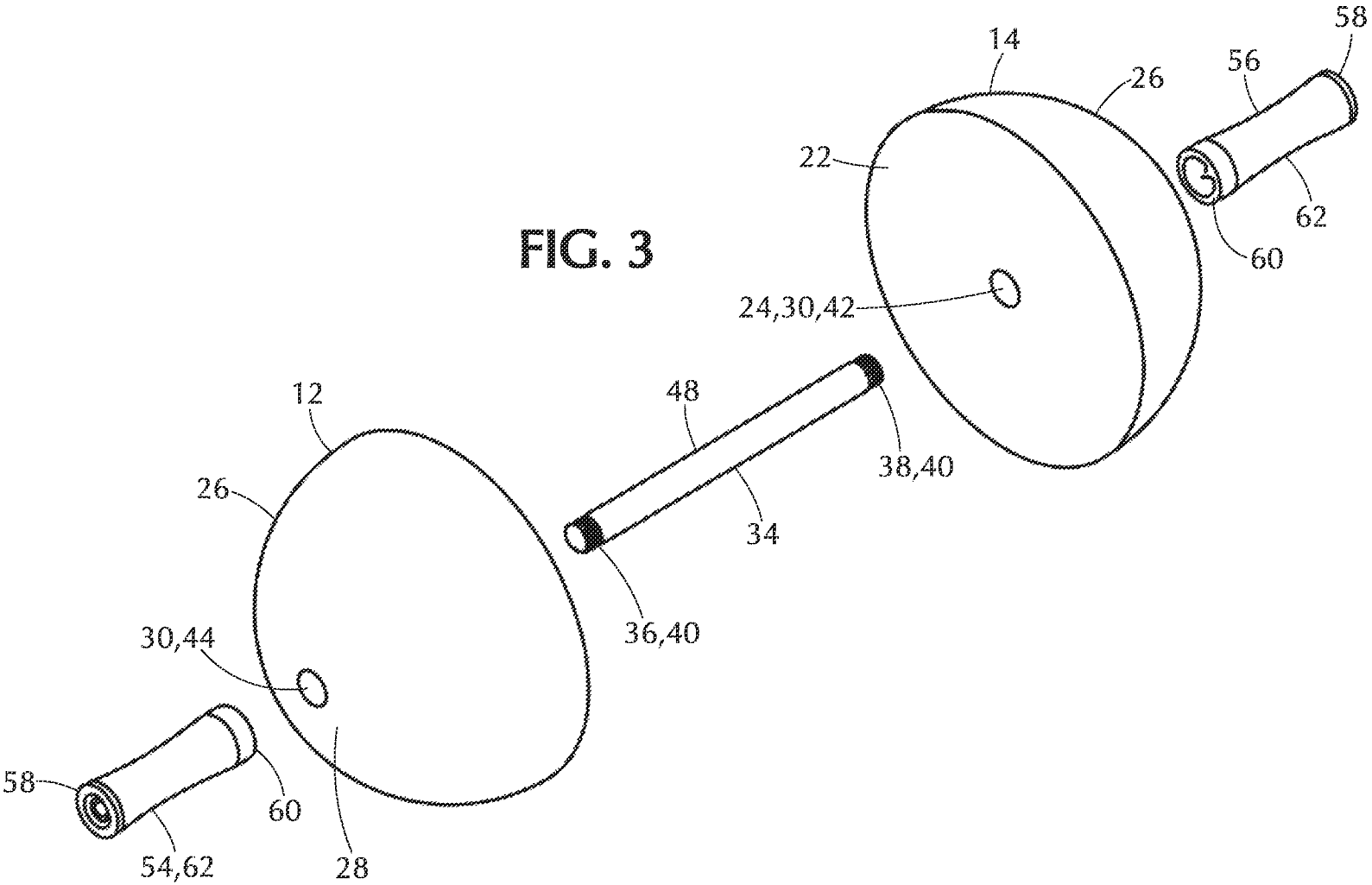
FIG. 3 is an exploded perspective view of the exercise device of FIG. 1.
Figure 4:
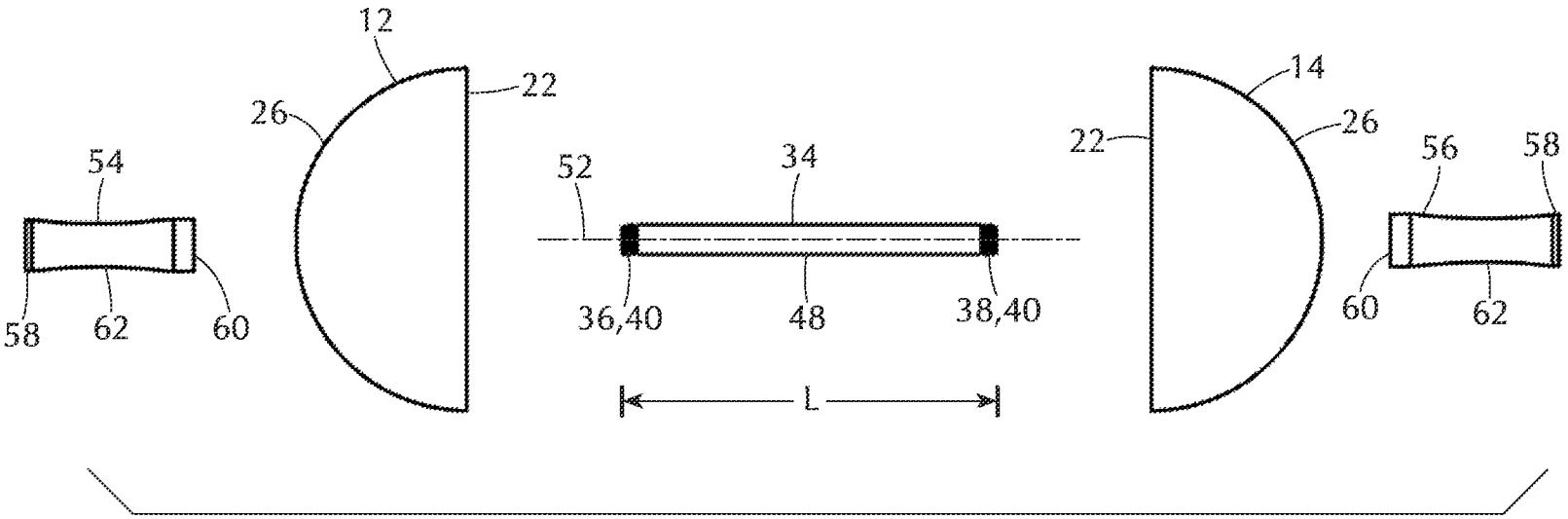
FIG. 4 is an exploded side view of the exercise device of FIG. 1.
Figure 5A:
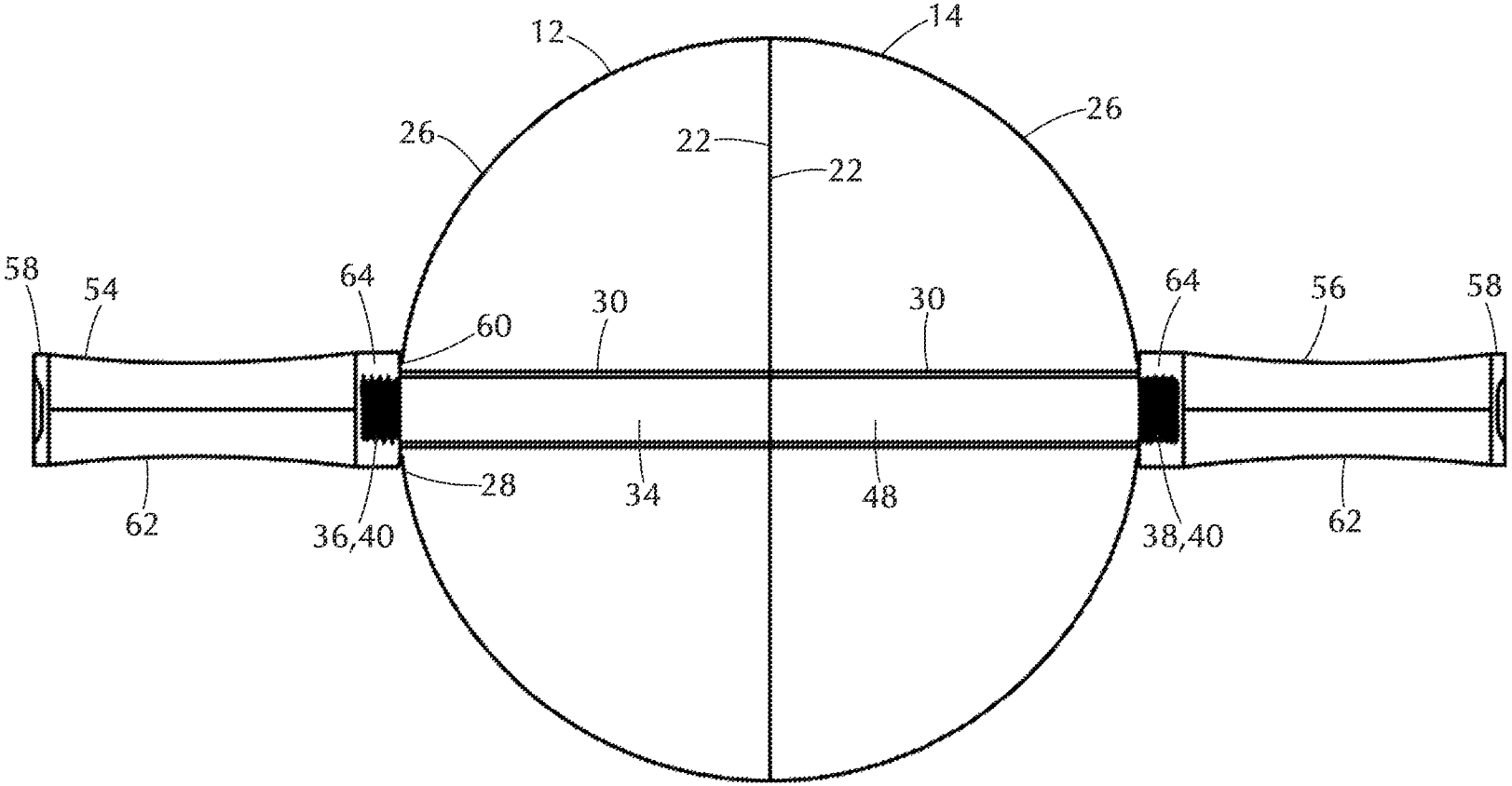
FIGS. 5A and 5B are each a cross-section view of the exercise device of FIG. 1, taken along line 5-5 of FIG. 2.
Figure 5B:
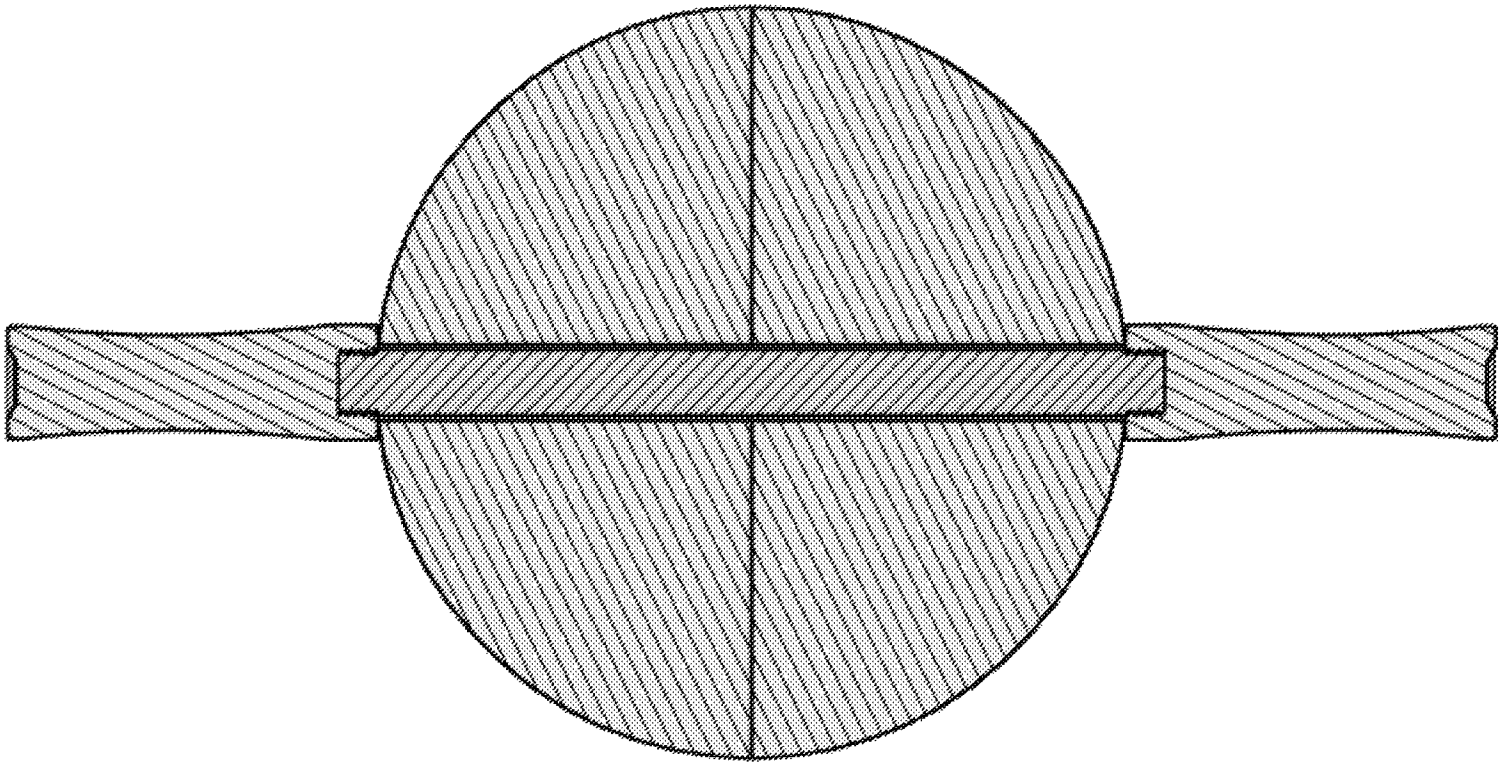
Figure 6:
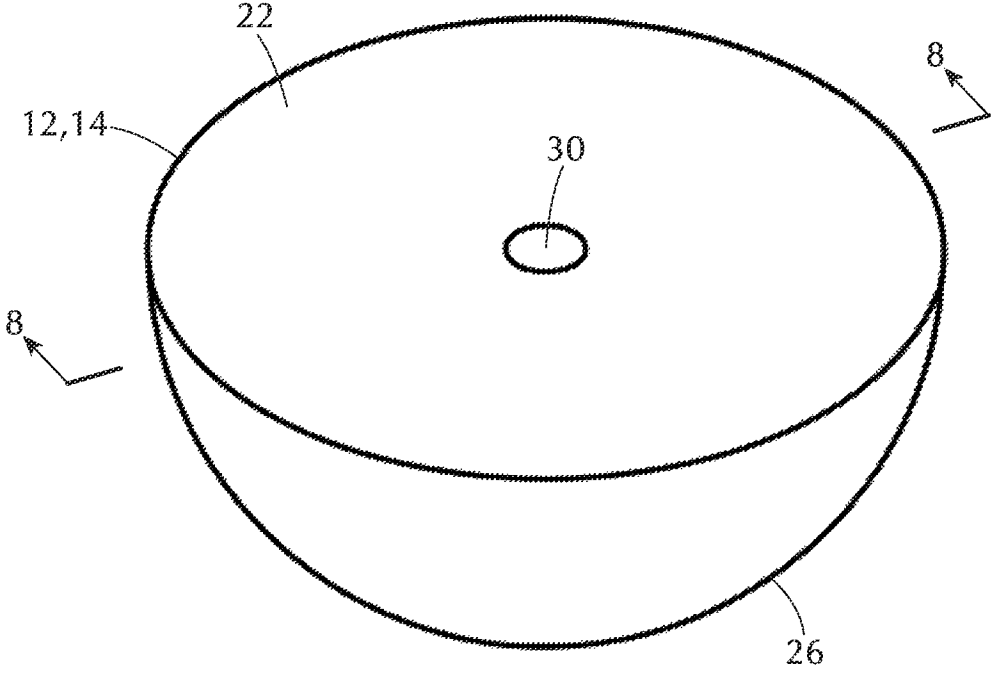
FIG. 6 is a perspective view of a hemispherical body of the exercise device of FIG. 1.
Figure 7:
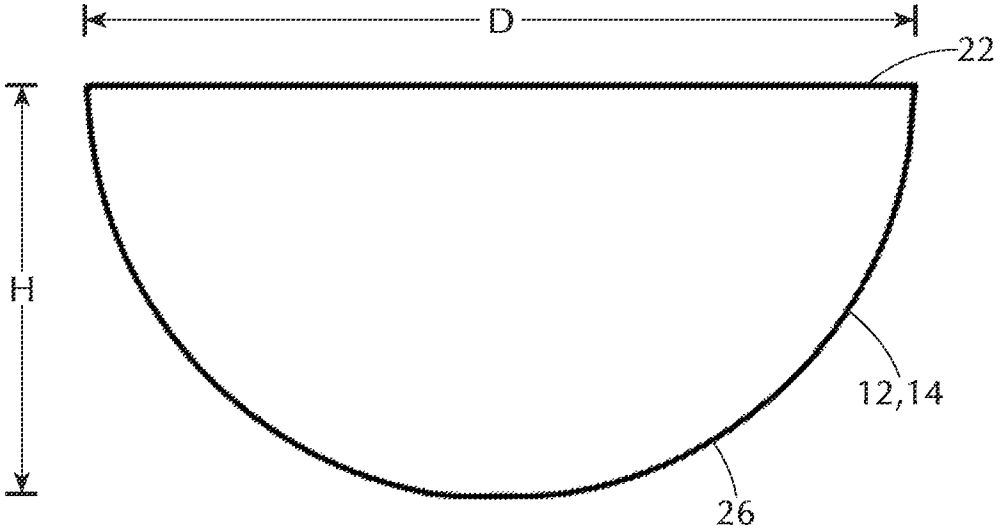
FIG. 7 is a side elevation view of the hemispherical body of FIG. 6.
Figure 8A:
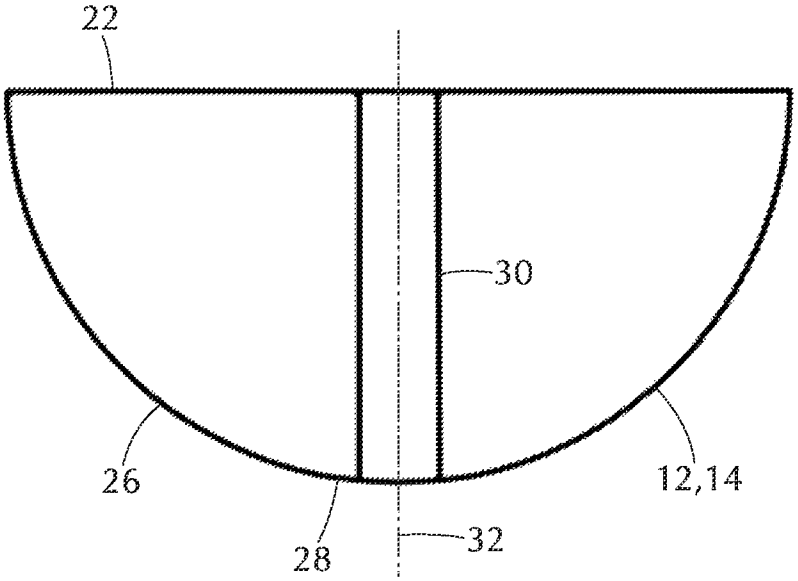
FIGS. 8A and 8B are each a side, cross-section view of the hemispherical body, taken along line 8-8 of FIG. 6.
Figure 8B:
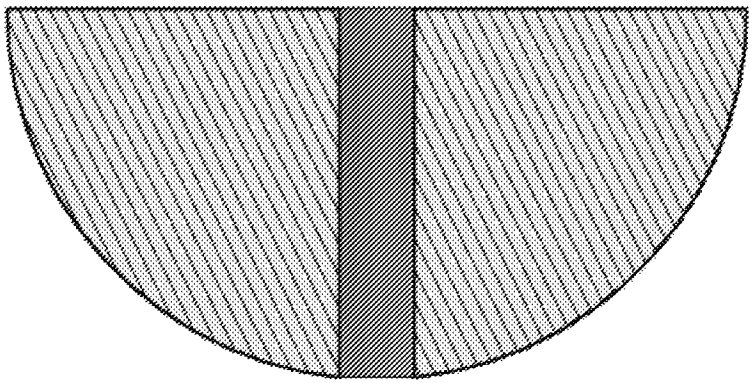
Figure 9:
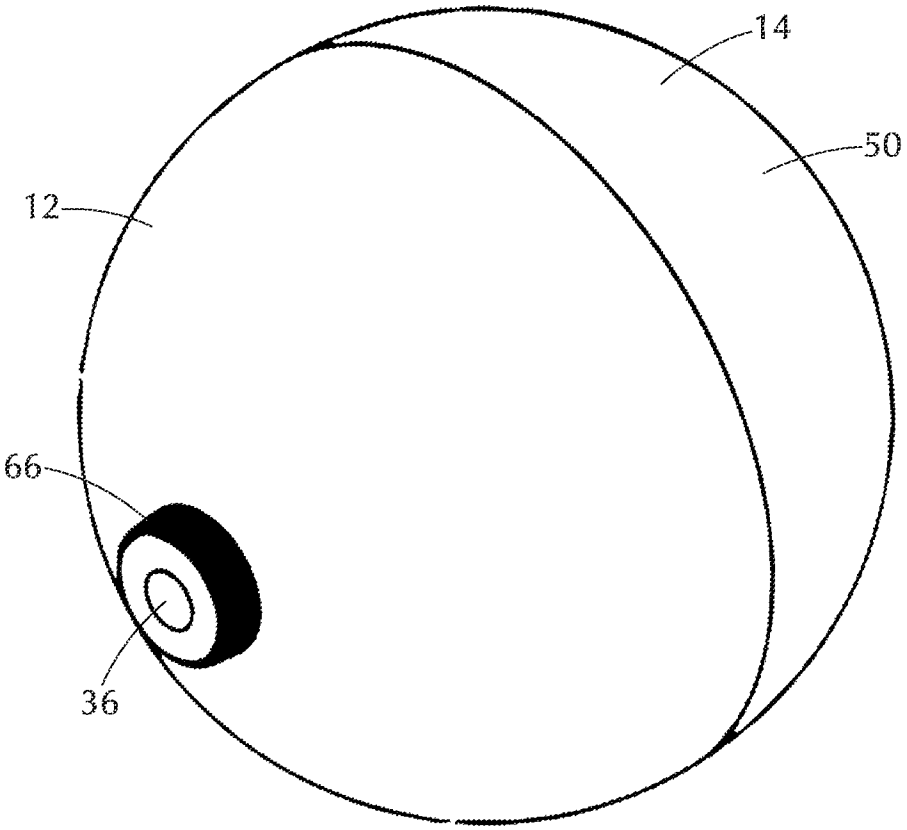
FIG. 9 is perspective view of a second preferred embodiment of the exercise device.
Figure 10:
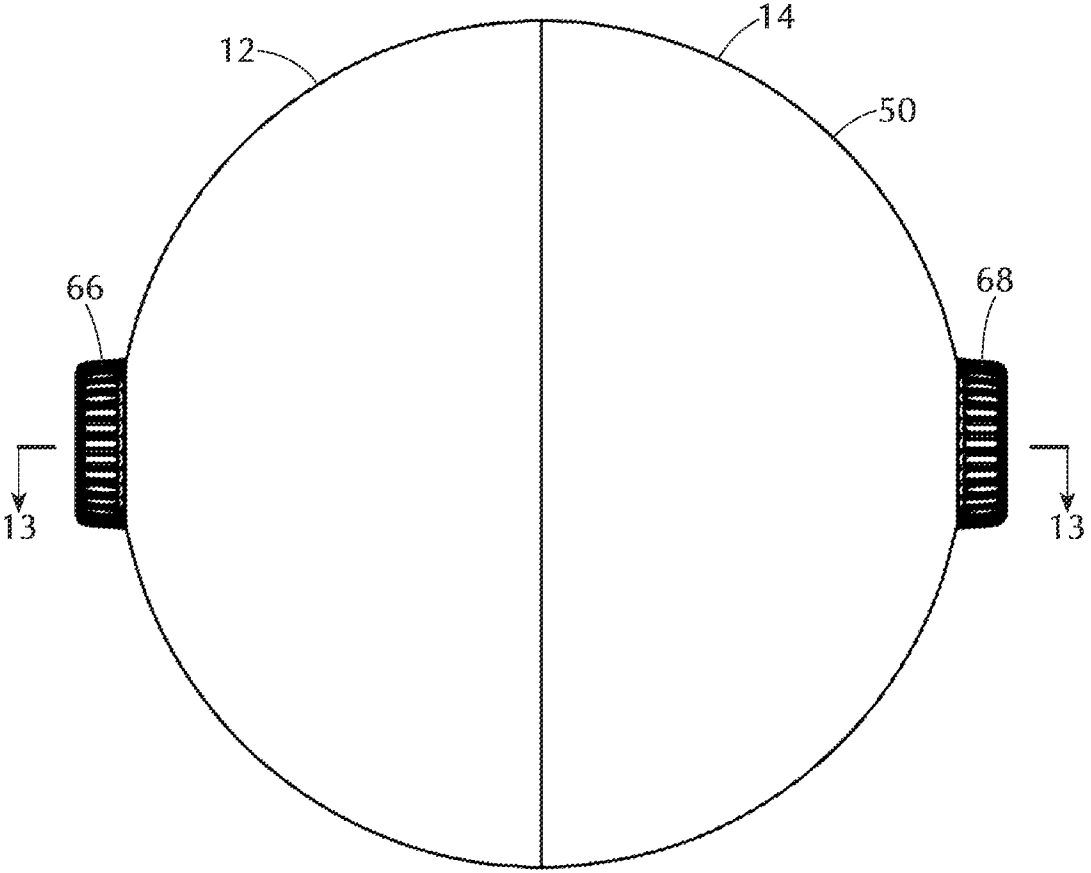
FIG. 10 side elevation view of the exercise device of FIG. 9.
Figure 11:
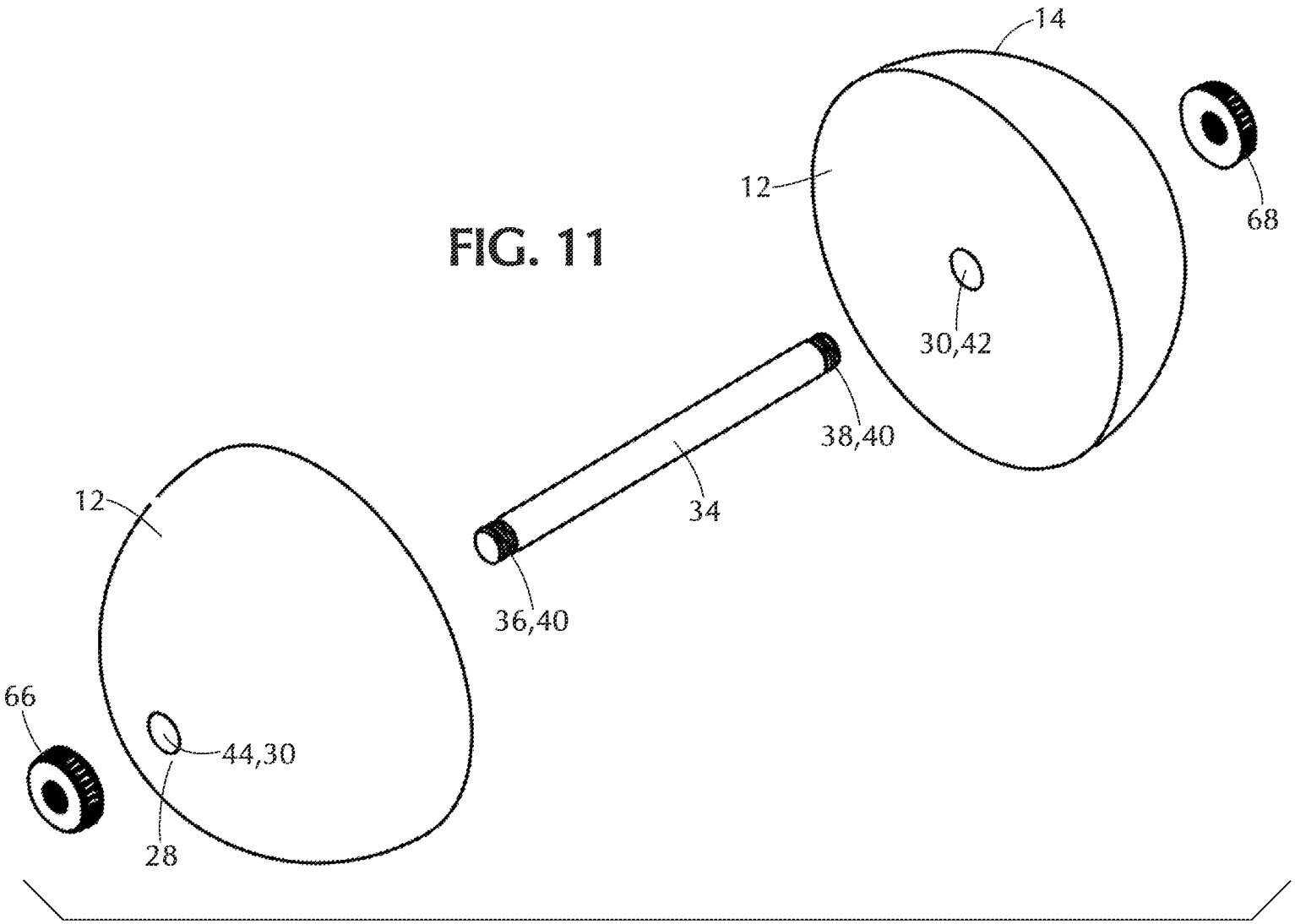
FIG. 11 is an exploded perspective view of the exercise device of FIG. 9.
Figure 12:
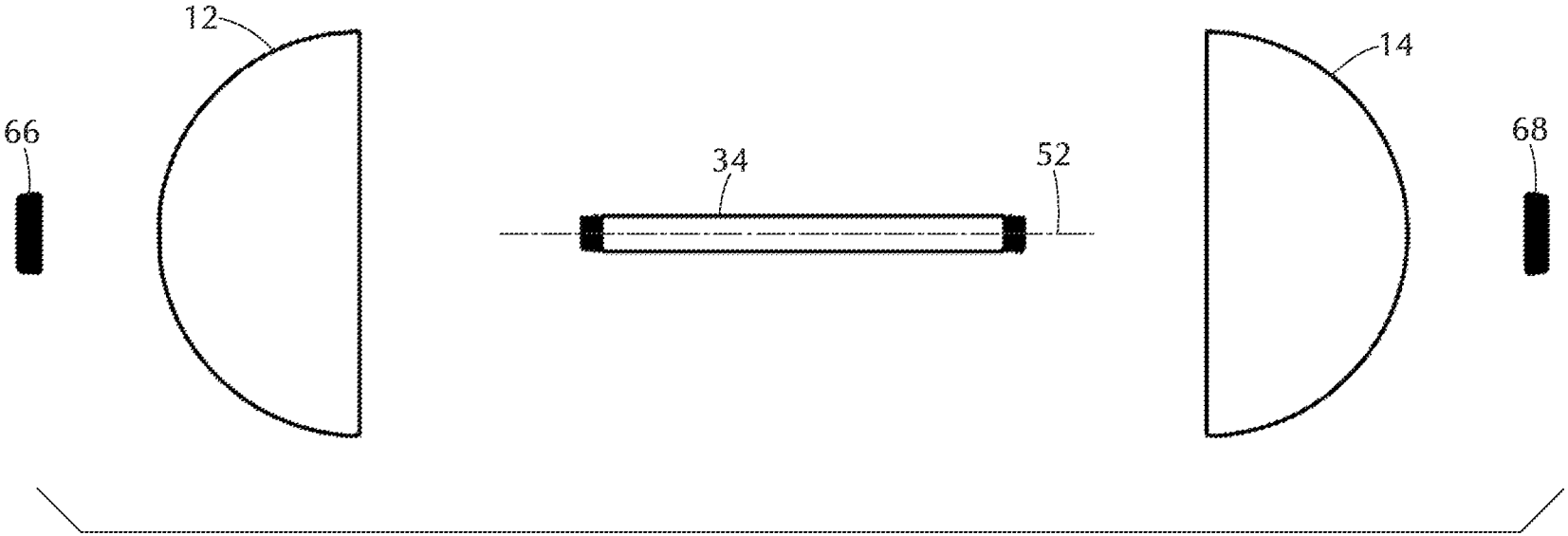
FIG. 12 is an exploded side view of the exercise device of FIG. 9.
Figure 13A:
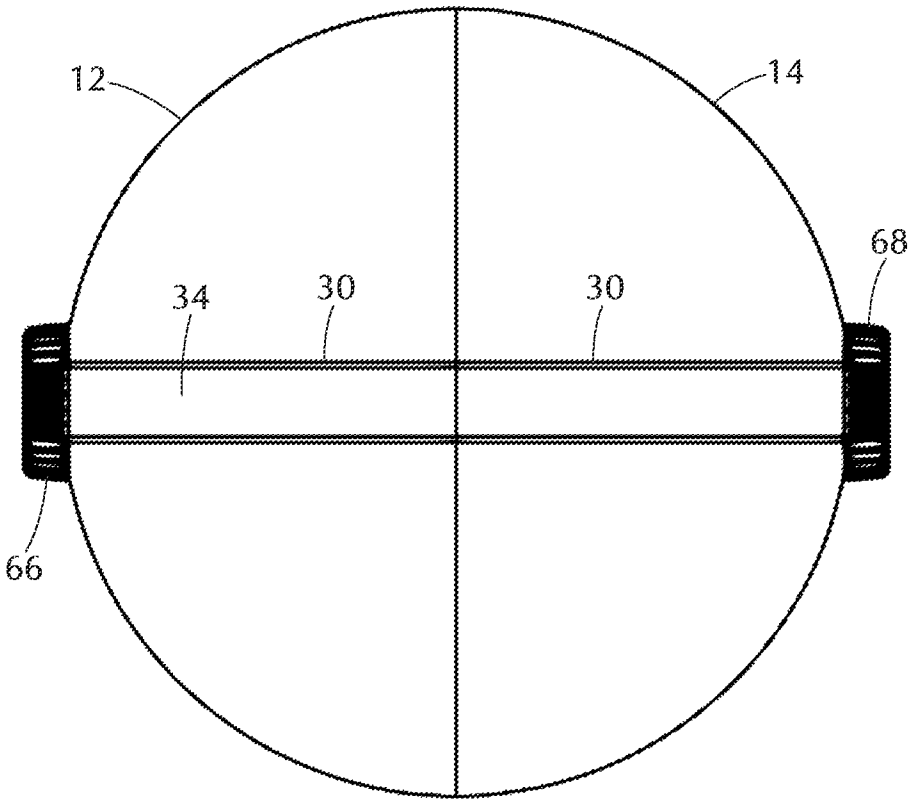
FIGS. 13A and 13B are each a side, cross-section view of the exercise device, taken along line 13-13 of FIG. 10.
Figure 13B:
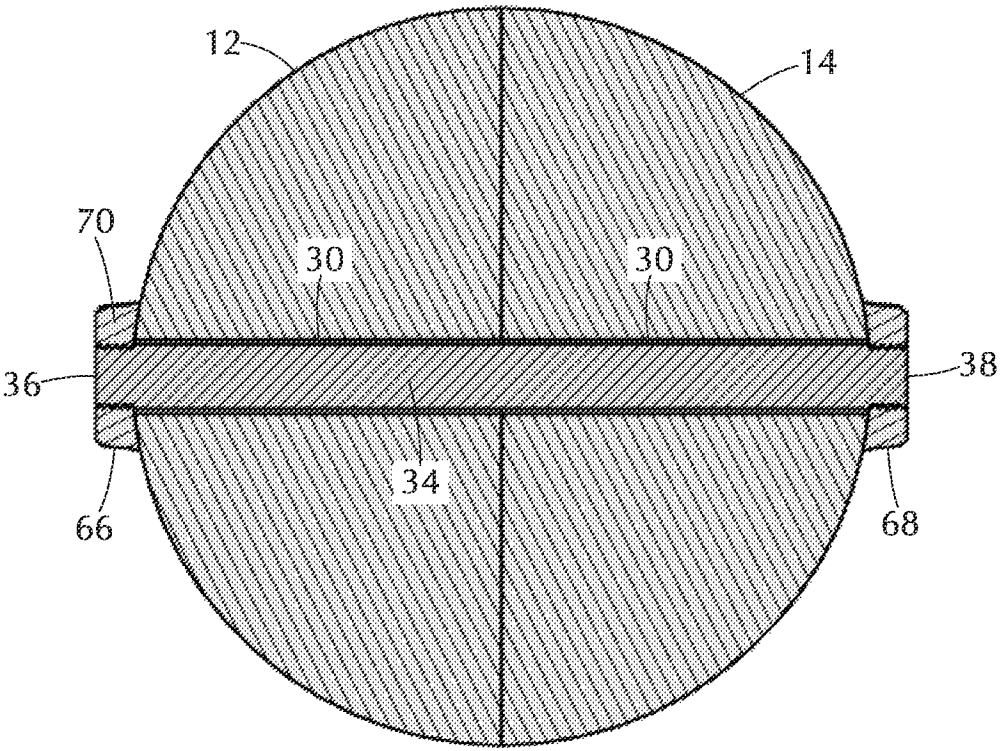
Figure 14:
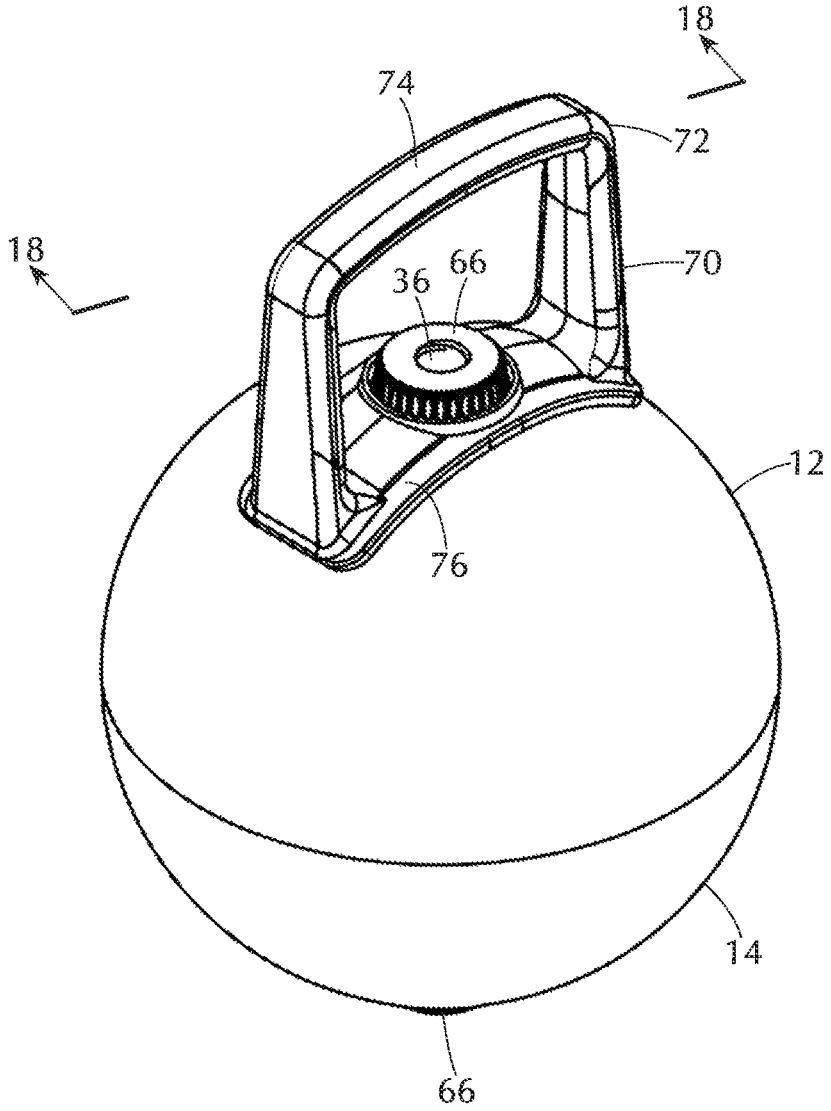
FIG. 14 is perspective view of a third preferred embodiment of the exercise device.
Figure 15:
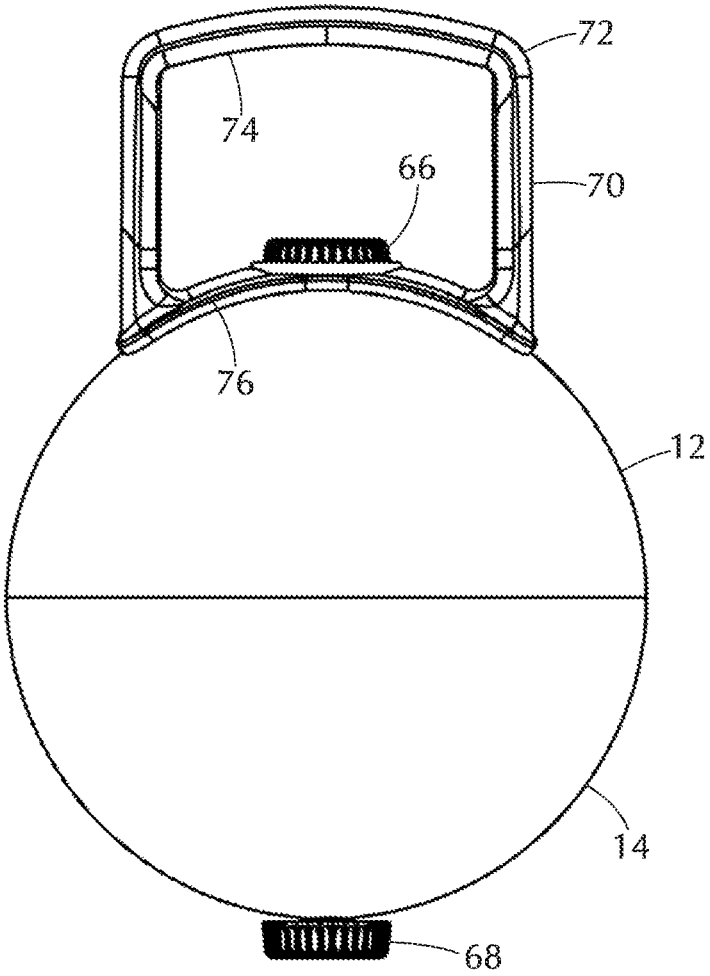
FIG. 15 side elevation view of the exercise device of FIG. 14.
Figure 16:
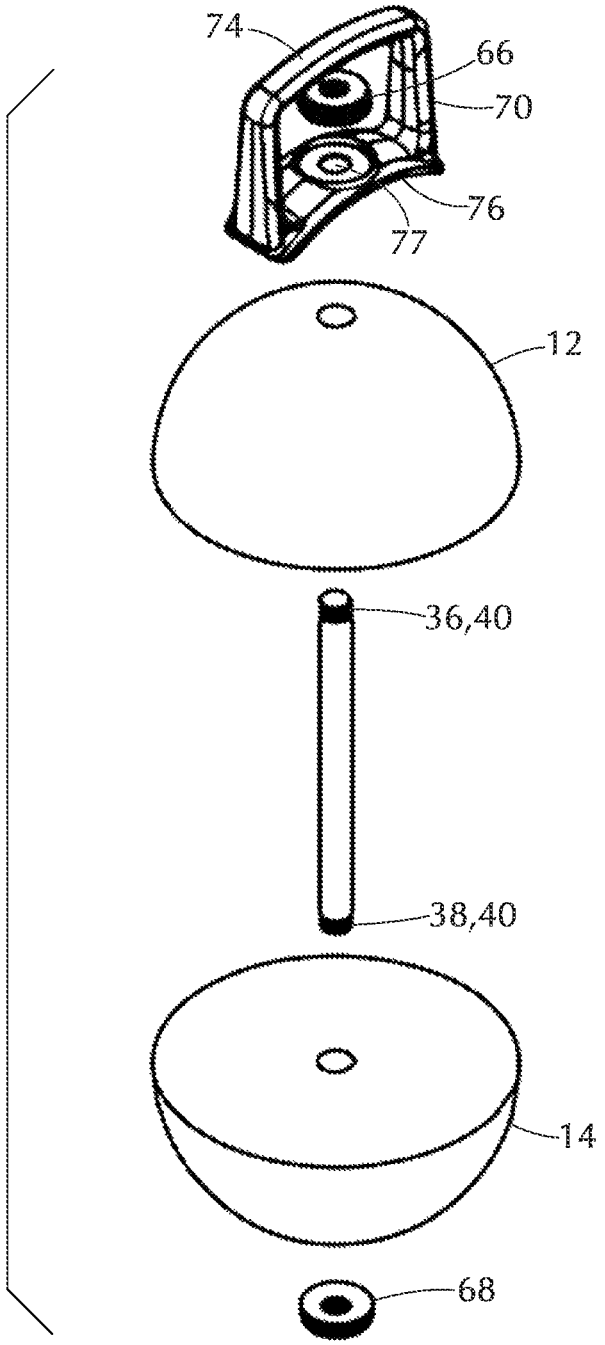
FIG. 16 is an exploded perspective view of the exercise device of FIG. 14.
Figure 17:
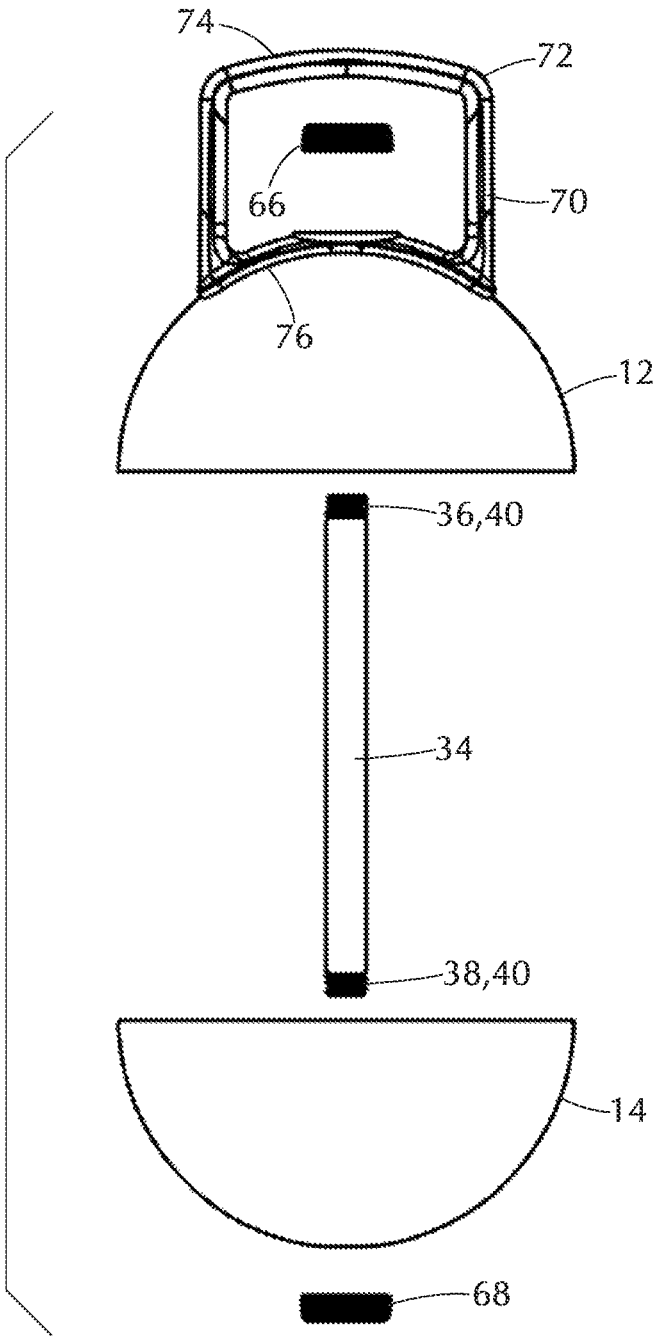
FIG. 17 is an exploded side view of the exercise device of FIG. 14.
Figure 18A:
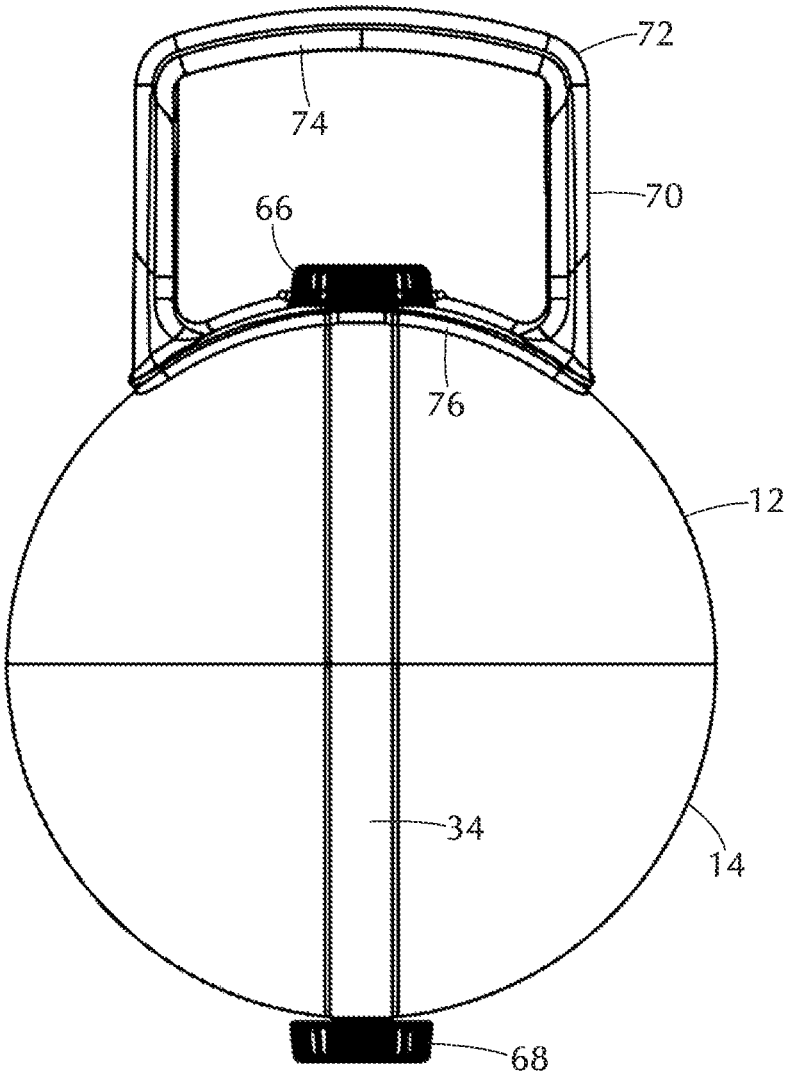
FIGS. 18A and 18B are each a side, cross-section view of the exercise device, taken along line 18-18 of FIG. 14.
Figure 18B:
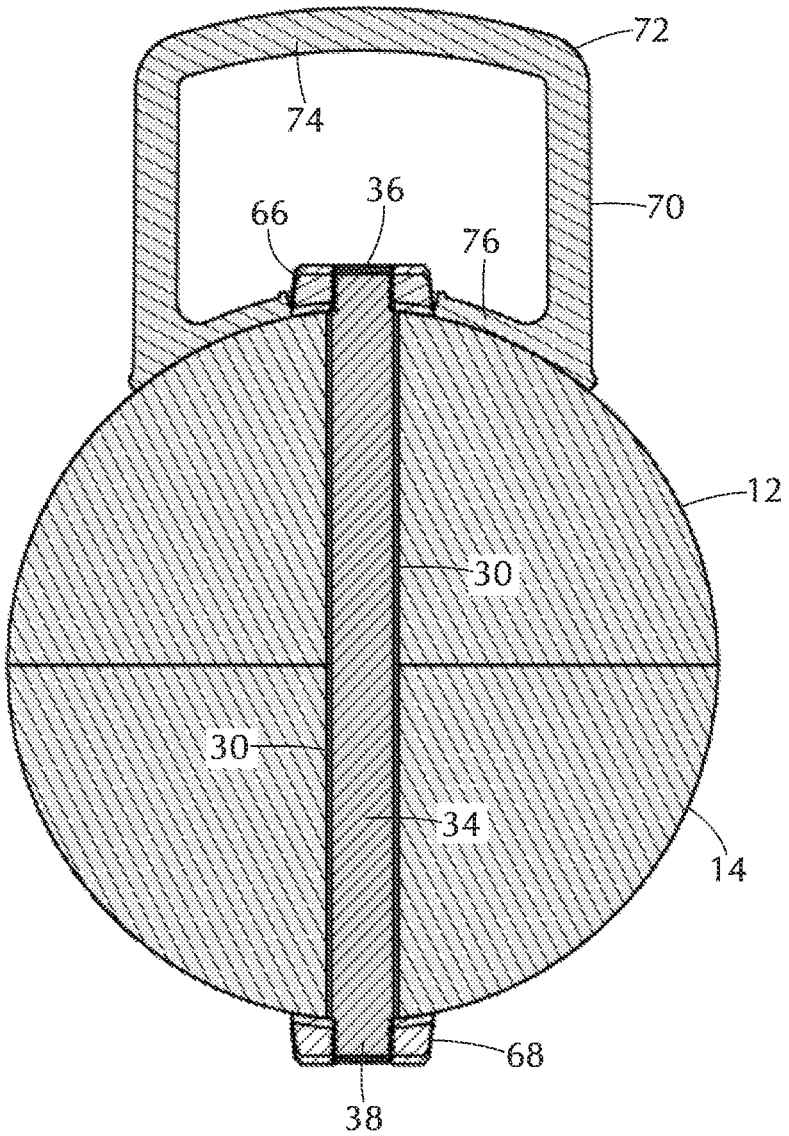
Figure 19:
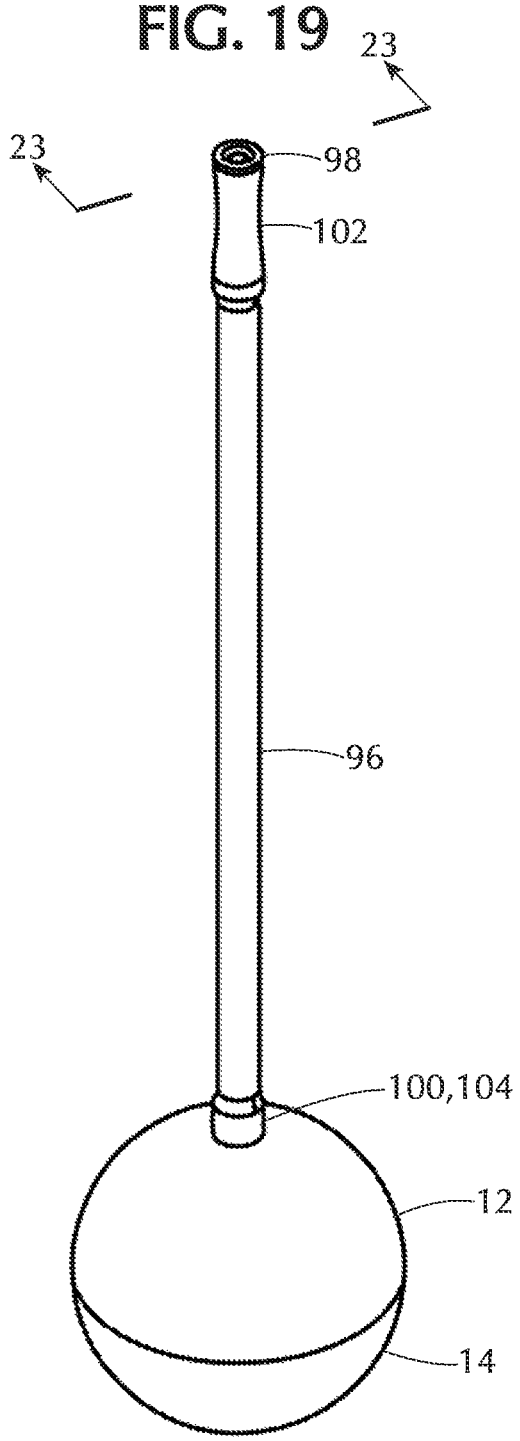
FIG. 19 is a perspective view of a fourth preferred embodiment of the exercise device.
Figure 20:
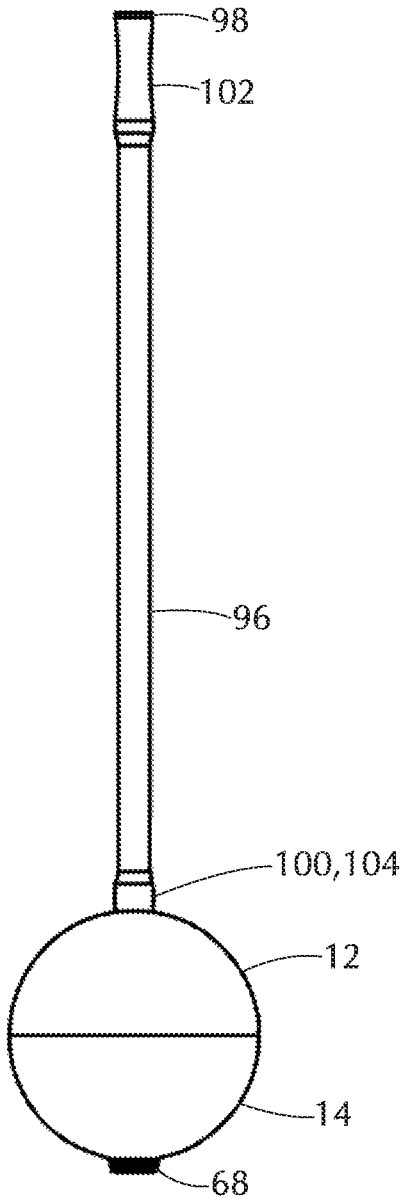
FIG. 20 side elevation view of the exercise device of FIG. 19.
Figure 21:
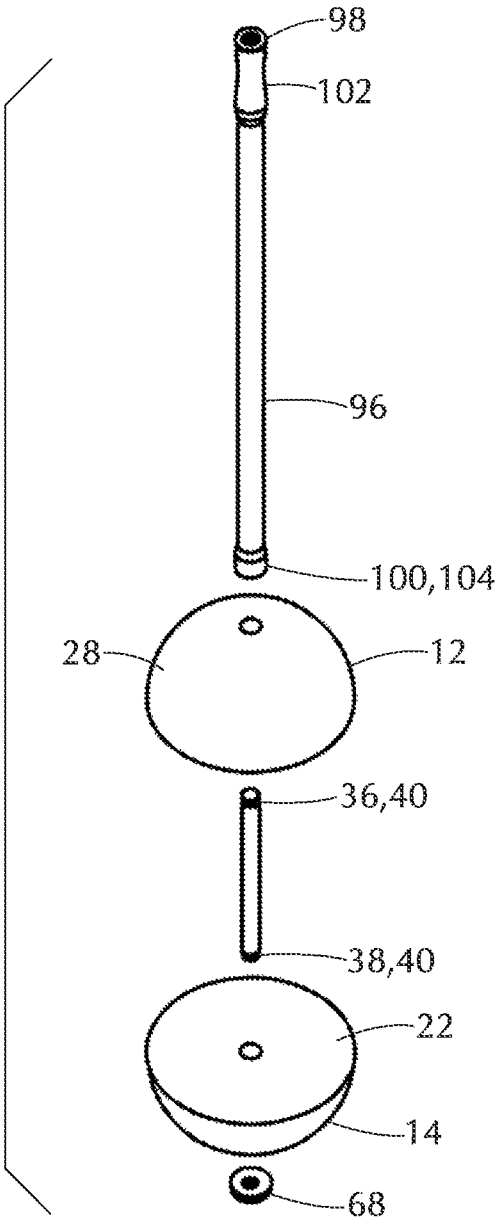
FIG. 21 is an exploded perspective view of the exercise device of FIG. 19.
Figure 22:
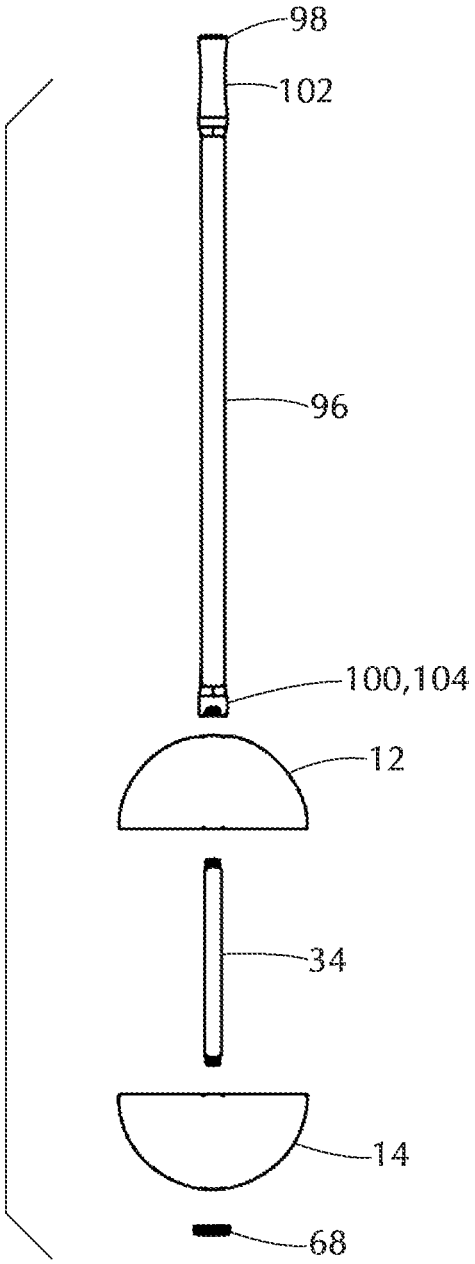
FIG. 22 is an exploded side view of the exercise device of FIG. 19.
Figure 23A:
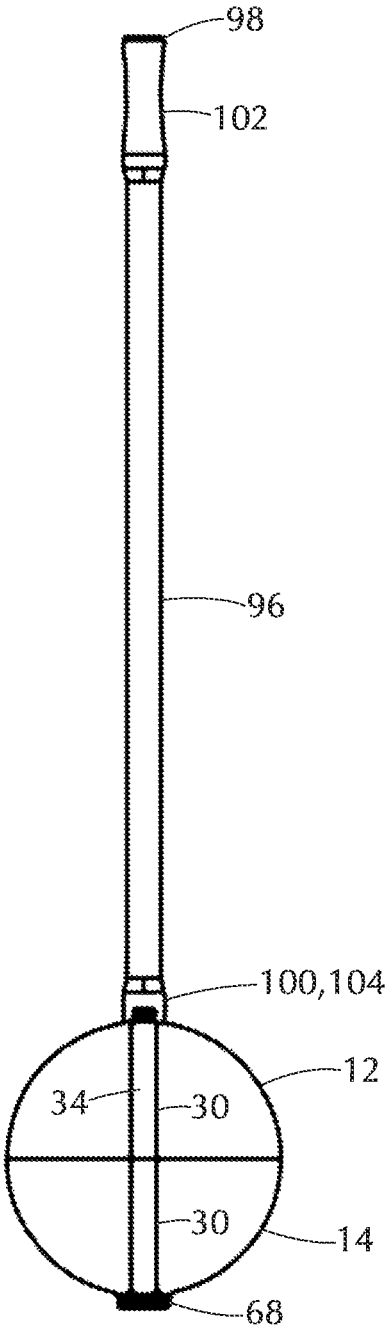
FIGS. 23A and 23B are each a side, cross-section view of the exercise device, taken along line 23-23 of FIG. 19.
Figure 23B:
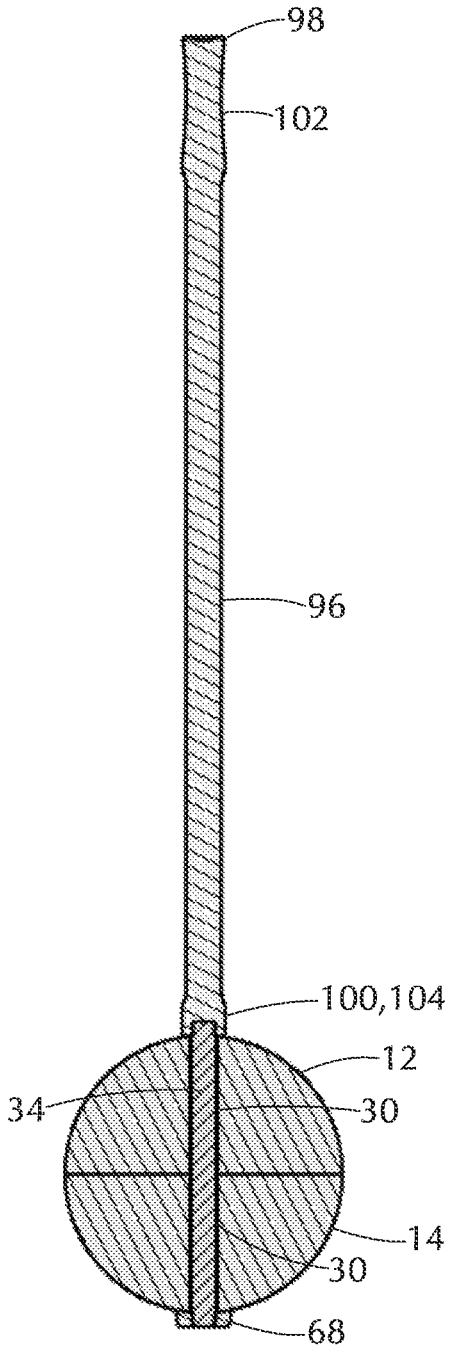

Referring to FIGS. 1-32, the exercise device 10 is a multi-purpose, full-body fitness device having multiple configurations and attachments which can be used for a variety of exercises. For example, the exercise device has a spherical configuration suitable for use as a medicine ball or the like, or as a rolling abdominal exercise device, or other uses. The exercise device 10 can also be disassembled such that the separate pieces can be used, for example, as push-up or balance supports. Other configurations and uses of the exercise device 10 are also possible.

Referring to FIGS. 1-8B, in a first preferred embodiment, which is particularly suitable for use for abdominal exercises or the like, the device 10 includes a pair of preferably substantially identical, substantially hemispherical bodies 12, 14. Each body preferably has a substantially planar, circular face 22 having a center 24, and has a substantially hemispherical dome 26 extending from the face 22, and the dome has an apex 28. Each body 12, 14 has an axis 32 which passes through the center 24 of the face 22 and through the apex 28 of the dome 26, and is preferably perpendicular to the face 22. A circumference of a base of the dome 26 is preferably coextensive with and in common to the circumference of the face 22.

Each body 12, 14 also includes a bore 30 extending from the face 22 to the apex 28 and forming openings 42, 44 in the face 22 and dome 26, respectively. The bore 30 is preferably parallel to and coaxial with the axis 32 of the body. The bore 30 is preferably tubular with a substantially constant, circular cross-section from the face 22 to the apex 28. Preferably, each bore 30 has a contiguous or substantially contiguous (e.g., tubular) inner wall 46 from the face 22 to the apex 28.

The bodies 12, 14 have an assembled configuration forming a substantially symmetrical spherical assembly 50 wherein the faces 22 of the bodies are in a substantially co-planar and closely abutting relationship (e.g., each face being on or adjacent an equatorial plane of the sphere), and with the axes 32 of the bodies being substantially aligned and colinear (e.g., lying on the same straight line). In this configuration, the bores 30 of the bodies 12, 14 are aligned such that they form a substantially contiguous passage through the spherical assembly 50.

Each body 12, 14 is configured to independently withstand a substantial adult human body weight or force placed anywhere thereon and in any orientation without substantial deformation, including when in the symmetrical spherical assembly 50, and when used separately in a face-down or face-up orientation. For example, when configured and used as a rolling abdominal exercise device, preferably no substantial deformation-induced rolling resistance occurs.

Each body 12, 14 may be solid, partially solid, or hollow and may be formed of rubber or a combination of rubber and other materials such as plastic. For example, the domes may be formed entirely of rubber (either solid or hollow), or can include a complete or partial rubber exterior coating. Each body 12, 14 preferably forms a substantially closed volume in that the face 22 and dome 26 form a contiguous junction around the perimeter of the face 22, each of the face 22 and dome 26 form a contiguous surface (except for the openings 42, 44 therein), and the bore 30 has a contiguous inner wall 46 between the face 22 and apex 28 of the dome, and the openings 42, 44 therein.

Each body 12, 14 can have a substantial weight such as about 2-8 lbs., so that the combined weight of the bodies can be about 4-16 lbs. The weight of the exercise device can be varied by providing bodies of different weights. However, each body preferably has substantially the same weight. The diameter D of the face 22 of each body 12, 14 is preferably about 8-12 inches and most preferably about 10 inches and a maximal height H of each body 12, 14, as measured from the face 22 to the apex 28 along the axis 32, is preferably about one-half the height H, or preferably about 4-6 inches and most preferably about 5 inches.

The exercise device 10 also includes a rod 34 which is configured to be received within the bores 30 of the bodies 12, 14 and is operable to join the hemispherical bodies 12, 14 in the spherical assembly 50. The rod 34 preferably has a central portion 48 which is preferably cylindrical with a substantially constant diameter along the length of the central portion 48, and the rod 34 has end portions 36, 38 on either side of the central portion 48. The rod 34 has a longitudinal axis 52 which is coaxial with the central portion 48 thereof.

The central portion 48 of the rod 34 preferably has a diameter sized to be closely received within the bore 30 of each body 12, 14 and configured to rotatably support each body in a stable manner so as to permit substantially free rotation of the body about the rod 34 and longitudinal axis 52 thereof, while preventing substantial tilt or wobble of the body relative to the axis 52 of the rod 34. For example, a maximal gap between the central portion 48 of the rod 34 and the inner wall 46 of the bore 30 can be less than about ⅜ inches and most preferably no greater than about ¼ inches. Preferably, the rod 34 and bodies 12, 14 are configured and operable for independent rotation of the bodies on the rod 34, but may be configured for common (e.g., linked) rotation.

The end portions 36, 38 of the rod 34 may include threaded portions 40 for connection of attachments and/or accessories as described herein. Preferably, the threaded portions 40 have external threads, and such external threads are preferably recessed such that a "major diameter" of the threads (i.e., a diameter of an imaginary co-axial cylinder that touches the crests of the external threads) is less than or equal to the diameter of rod 34.

The rod 34 is preferably configured with an overall length "L" (e.g., as measured parallel to the longitudinal axis 52) such that, when the rod 34 is inserted into the spherical assembly 50 of the bodies 12, 14, the central portion 48 of the rod 34 extends beyond (or at least substantially spans between) the apex 28 of each body 12, 14 (and openings 44 thereof), and the end portions 36, 38 of the rod 34, including the threaded portions 40 thereof, are disposed entirely outwardly of (or at least extend outwardly from) the spherical assembly 50. For example, a length of the central portion 48 and/or the overall length of the rod 34 can be greater than twice the height H of each body 12, 14.

The exercise device 10 preferably includes a pair of handles 54, 56, each of which can have an outer end 58, an inner end 60 and a hand grip 62 between the inner and outer ends, where each hand grip is sized and configured to be grasped by a human hand. Each handle 54, 56 is configured to connect to one (or either one) of the end portions 36, 38 of the rod 34. For example, the inner end 60 of each handle preferably includes internal threads 64 configured to engage the threaded portions 40 of the rod 34, to releasably and securely attach the handles to the rod 34. When the handle 54, 56 is connected to the rod 34, the hand grip 62 can be substantially coaxial with the axis 52 of the rod (as shown) or can be perpendicular thereto, or another suitable orientation.

Preferably, the handles 54, 56 and rod 34 are configured such that when the handles 54, 56 are fully connected to the rod 34 (e.g., maximally screwed on to the rod 34), the inner end 60 of each handle is disposed closely adjacent to the apex 28 of the associated body 12, 14 (e.g., preferably within about ¼ inches, and most preferably within about $1/16^{th}$ inches) and is configured such that each handle serves as a stop to confine the associated body 12, 14 and together serve to prevent substantial axial movement of the bodies 12, 14 relative to the axis 52 of the rod 34 so that the first and second bodies are confined in the spherical assembly 50. However, in the fully connected state, the handles 54, 56 preferably do not clamp (or do not substantially clamp) the bodies 12, 14 therebetween such that the bodies can substantially freely rotate relative to the rod 34. The inner end 60 of each handle 54, 56 preferably has a diameter (or other effective dimension) greater than a diameter of the opening 44 of the dome 26 of the associated body 12, 14 such that it contacts the dome surrounding (or on either side of) the opening 44 so as to effectively limit axial movement of the body.

As an alternative, one of the handles 54, 56 can be permanently attached to an end 36, 38 of the rod 34 (or integrally formed with the rod 34), and the other handle can be removably attachable to the rod as described herein, to permit reconfiguration of the exercise device 10.

In this configuration, the bodies can, together or independently, support a substantial weight of a human body applied thereto without substantial deformation, including when such weight is applied to the handles which is transmitted by the rod to the bore(s) of the bodies and then through the bodies to a floor or other surface.

In this configuration, with the handles 54, 56 attached to the exercise device 10 in the spherical assembly 50, the device is operable to be used as a rolling abdominal exercise device such as by taking a kneeling or prone position, grasping and applying downward pressure to the handles 54, 56 and rolling the device on the floor, alternately away from and towards oneself, with the exercise device 10 partially supporting the weight of the user and the bodies 12, 14 rotating around the rod 34 and axis 52 thereof.

The spherical shape of the spherical assembly 50 allows for easier changes of direction when rolling the abdominal exercise device on a floor surface, by tilting one of the handles 54, 56 down toward the rolling surface (e.g., tilting the device about a horizontal axis), which can substantially reduce or eliminate the need to twist the device (e.g., about a vertical axis) to affect a direction change.

Alternatively, the bodies 12, 14 can be assembled in other configurations such as with the apexes 28 abutting, or the face 22 of one body 12 abutting the apex 28 of the other body 14, and mounted to the rod 34, as described herein.

Referring to FIGS. 9-13B, in a second preferred embodiment, which is particularly suitable for medicine ball-type exercises or the like, the exercise device 10 can include a pair of end caps 66, 68 configured to connect to the ends 36, 38 of the rod 34 when the device is in the spherical assembly 50, in lieu of (and, for example, in a similar manner as) the aforementioned handles. Preferably, the end caps 66, 68 are configured such that when they are fully connected to the rod 34 (e.g., maximally screwed on to the rod 34), each end cap is disposed closely adjacent to the apex 28 of the associated body 12, 14 (e.g., preferably within about 0¼ inches, and most preferably within about 1/16th inches) and is configured so as to act as a stop to confine the associated body 12, 14, and together serve to prevent substantial axial movement of the bodies 12, 14 relative to the axis 52 of the rod 34 so that the first and second bodies are confined in the spherical assembly 50. Each end cap 66, 68 preferably has a diameter (or other effective dimension) suitable for gripping and tightening by one hand of a human hand and also greater than a diameter of the opening 44 of the dome 26 of the associated body 12, 14 so as to effectively limit axial movement of the body.

The end caps 66, 68 preferably have internal threads 70 configured to connect to the threaded portions 40 of the rod 34 and preferably have a relatively low-profile or otherwise project minimally from the associated body 12, 14. The end caps 66, 68 and rod 34 can be alternately configured such that, when the end caps are fully secured (i.e., maximally screwed on) to the rod, the end caps do (or do not) exert a clamping force on the bodies 12, 14. As such, the internal threads 70 of the end caps 66, 68 can be within a through hole communicating with both sides of the end cap, as shown. As an alternative, one of the end caps 66, 68 can be permanently attached to an end 36, 38 of the rod 34 (or integrally formed with the rod 34), and the other end cap can be removably attachable to the rod 34 as described herein to permit reconfiguration of the exercise device 10.

In this configuration, the exercise device may be used as a medicine ball and for the various exercises suitable therefore, such as by holding it with both hands while seated on the floor and leaning back slightly, then alternating moving the ball from one side of the body to the other (Russian Twists) as well as holding it with both hands and performing traditional sit-ups while pressing it up overhead.

Alternatively, the bodies 12, 14 can be assembled in other configurations such as with the apexes 28 abutting, or the face 22 of one body 12 abutting the apex 28 of the other body 14, and mounted to the rod 34, as described herein.

Referring to FIGS. 14-18B, in a third preferred embodiment, which is particularly suitable for kettlebell-type exercises or the like, the exercise device 10 can include a kettlebell handle 70 having an outer end 72 with a hand grip 74 and an inner end 76. The kettlebell handle 70 is configured to mount over or connect to one (or either one) of the end portions 36, 38 of the rod 34, for example when the device is in the spherical assembly 50. For example, the inner end base 76 of the kettlebell handle 70 can include an opening 77 sized to receive an end of the rod 34 therethrough, and one of the aforementioned end caps 66, 68 can be connected to such end to securely and releasably attached the kettlebell handle 70 to the spherical assembly 50. Alternatively, the base end 76 of the kettlebell handle can include threads (not shown) configured to engage the threaded portions 40 of the rod 34, to releasably and securely attach the kettlebell handle to the rod 34. When the kettlebell handle 70 is connected to the rod 34, the hand grip 74 thereof can be substantially perpendicular with the axis 52 of the rod (as shown) or can be parallel thereto, or another suitable orientation.

The kettlebell handle 70 is preferably used in conjunction with one of the aforementioned end caps 66, 68, with one end cap 66, 68 connected to the other end 36, 38 as described herein.

Preferably, the kettlebell handle 70 and rod 34 are configured such that when the kettlebell handle 70 is fully connected to the rod 34, the inner end 76 thereof is disposed closely adjacent to the apex 28 of the associated body 12, 14 and is configured such that the kettlebell handle serves as a stop to confine the associated body 12, 14 and together with the one end cap 36, 38, serve to prevent substantial axial movement of the bodies 12, 14 relative to the axis 52 of the rod 34 so that the first and second bodies are confined in the spherical assembly 50. In the fully connected state, the kettlebell handle 70 and associated end cap 36, 38 can be alternately configured to clamp (or not substantially clamp) the bodies 12, 14 therebetween. The inner end 76 of the kettlebell handle 70 preferably has a diameter (or other effective dimension) greater than a diameter of the opening 44 of the dome 26 of the associated body 12, 14 so as to effectively limit axial movement of the body.

As an alternative, one of the kettlebell handle 70 or the one end cap 36, 28 can be permanently attached to an end 36, 38 of the rod 34, and the other one of the kettlebell handle 70 and one end cap 36, 38 can be removably attachable to the rod as described herein, to permit reconfiguration of the exercise device 10.

In this configuration, the exercise device 10 may be used as a kettlebell and for the various exercises suitable therefore, such as by holding it with both hands in front of the chest and performing kettlebell goblet squats, holding it with both hands and performing kettlebell swings between the legs and holding it with one hand while bent at the waist and performing one-arm kettlebell back rows.

Referring to FIGS. 19-23B, in a fifth preferred embodiment, which is particularly suitable for hammer- or mace-type exercise or the like, the exercise device 10 can include an elongated mace handle 96 having first and second end portions 98, 100 and having a grip portion 102 on or adjacent the first end portion 98 and can have a length and configuration suitable for griping by two hands. The mace handle 96 can have a permanent or removable stop 104 disposed on or adjacent to the second end portion 100.

The second end portion 100 of the mace handle 96 is preferably configured to connect to one end 36, 38 of the rod 34 disposed within the spherical assembly 50, with an end cap 66, 68 connected to the other end of the rod 34 as described herein to create an assembly of the mace handle 96, rod 34 and spherical assembly 50.

Alternatively, the structure of the mace handle 96 and rod 34 can be an integral structure such that the spherical assembly 50 is mounted thereon with one end cap 66, 68 connected to the end thereof.

In this configuration, the exercise device 10 may be used as a hammer or mace exercise device and for the various exercises suitable therefore, such as by holding it with both hands straight up in front of the body and performing squats, holing it parallel to the ground with body hands in front of your body and pressing it over your head, and holding it with both hands over the head and swinging it in circles.

Figure 24:
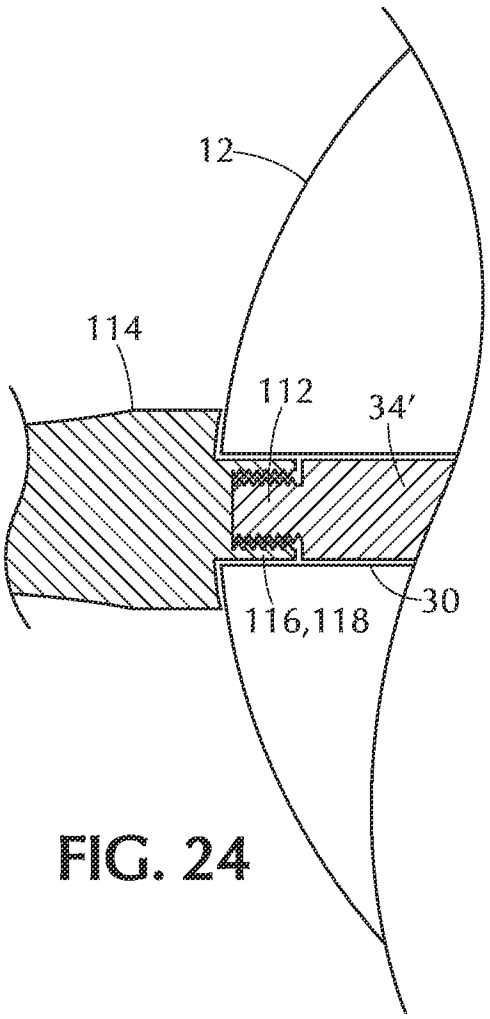
FIG. 24 is a cross section view of an alternative threaded connection of the exercise device.

Referring to FIG. 24, as described herein the rod 34' can have an externally threaded portion 112 which is substantially recessed such that a "major diameter" of the threads (i.e., a diameter of an imaginary co-axial cylinder that touches the crests of the external threads) is substantially less the diameter of the associated end portion of the rod 34'. In addition, the various attachments 114 to the rod 34' (e.g., the handles 54, 56, end caps 66, 68, and/or kettlebell handle 70) can have inner ends 116 (e.g., the inner ends 60, 76) with internal threads 118 configured to connect to the external threads of the rod 34'. Further, the inner ends 116 of the attachments 114 can be configured to project partially or wholly into the bore 30 of the bodies 12, 14 and to connect to the rod 34' disposed therein. For example, an overall length of the rod 34' can be less than twice the height H of each body 12, 14 such that both (or one of the) threaded portions 112 thereof are disposed entirely within the spherical assembly 50 described herein, and the attachments 114 can be configured for connection thereto within the body 12, 14.

Figure 25:
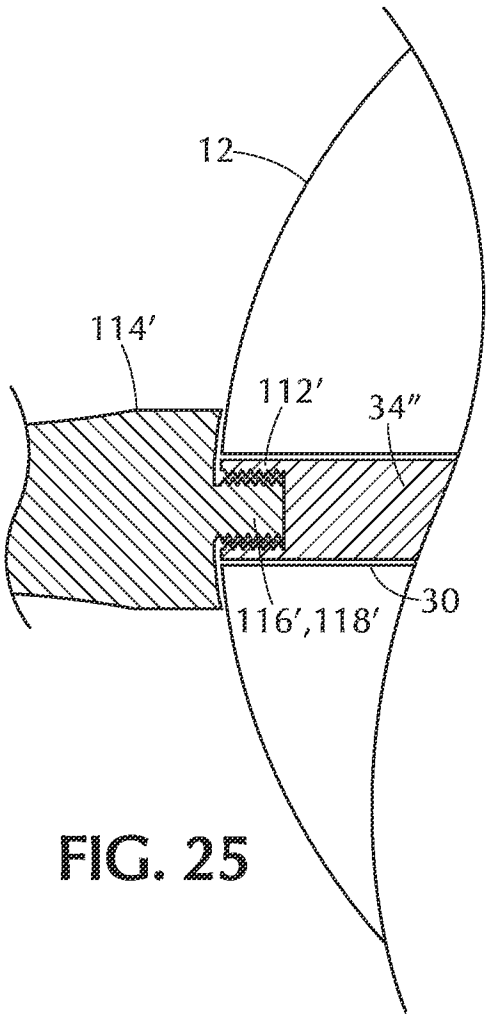
FIG. 25 is a cross section view of a further alternative threaded connection of the exercise device.
Figure 26:
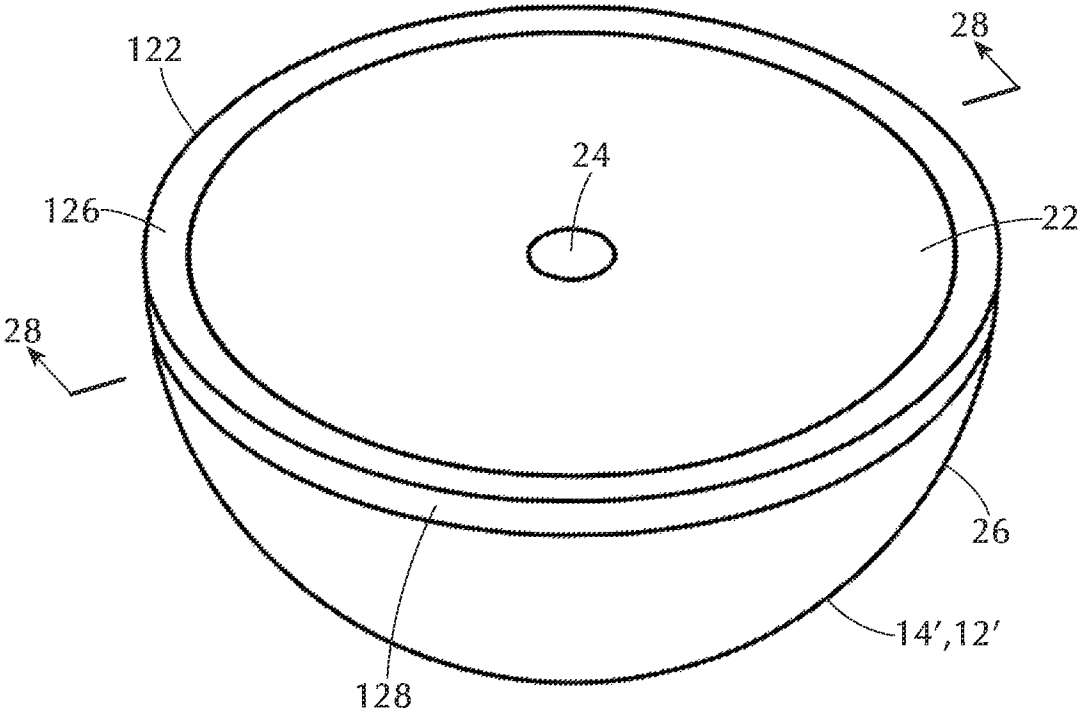
FIG. 26 is a perspective view of an additional preferred embodiment of a hemispherical body of the exercise device.
Figure 27:
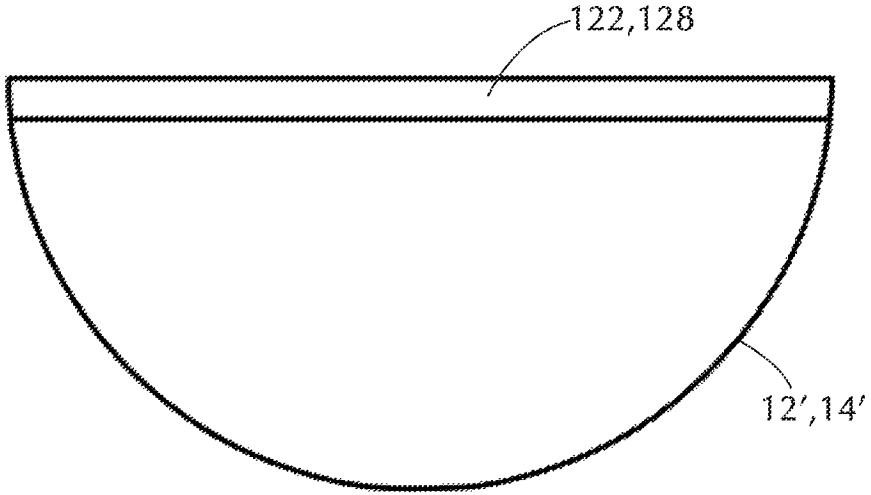
FIG. 27 is a side elevation view of the hemispherical body of FIG. 24.
Figure 28A:
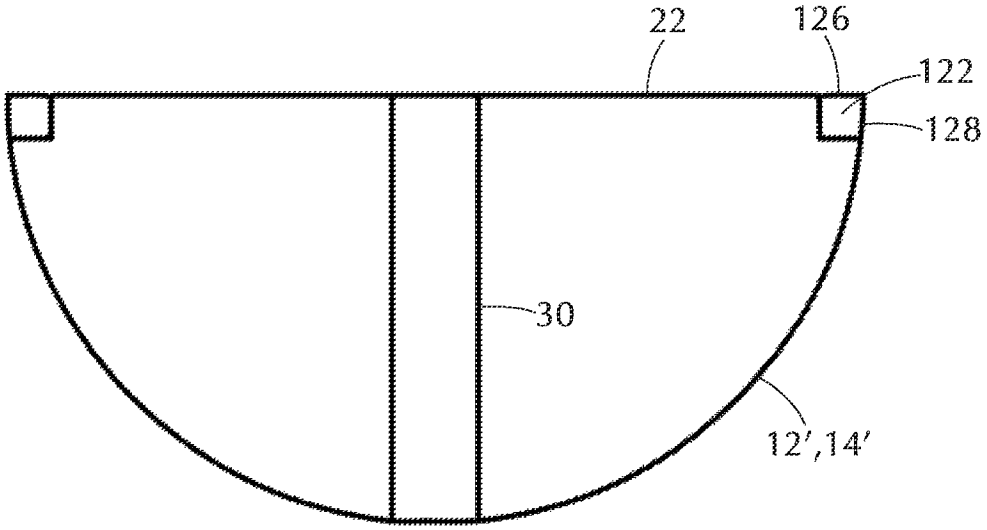
FIGS. 28A and 28B are each a side, cross-section view of the hemispherical body, taken along line 28-28 of FIG. 27.
Figure 28B:
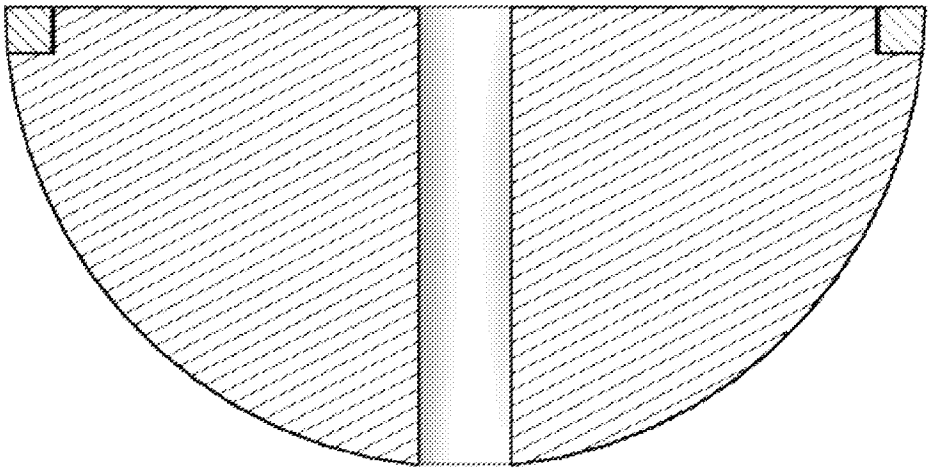
Figure 29:
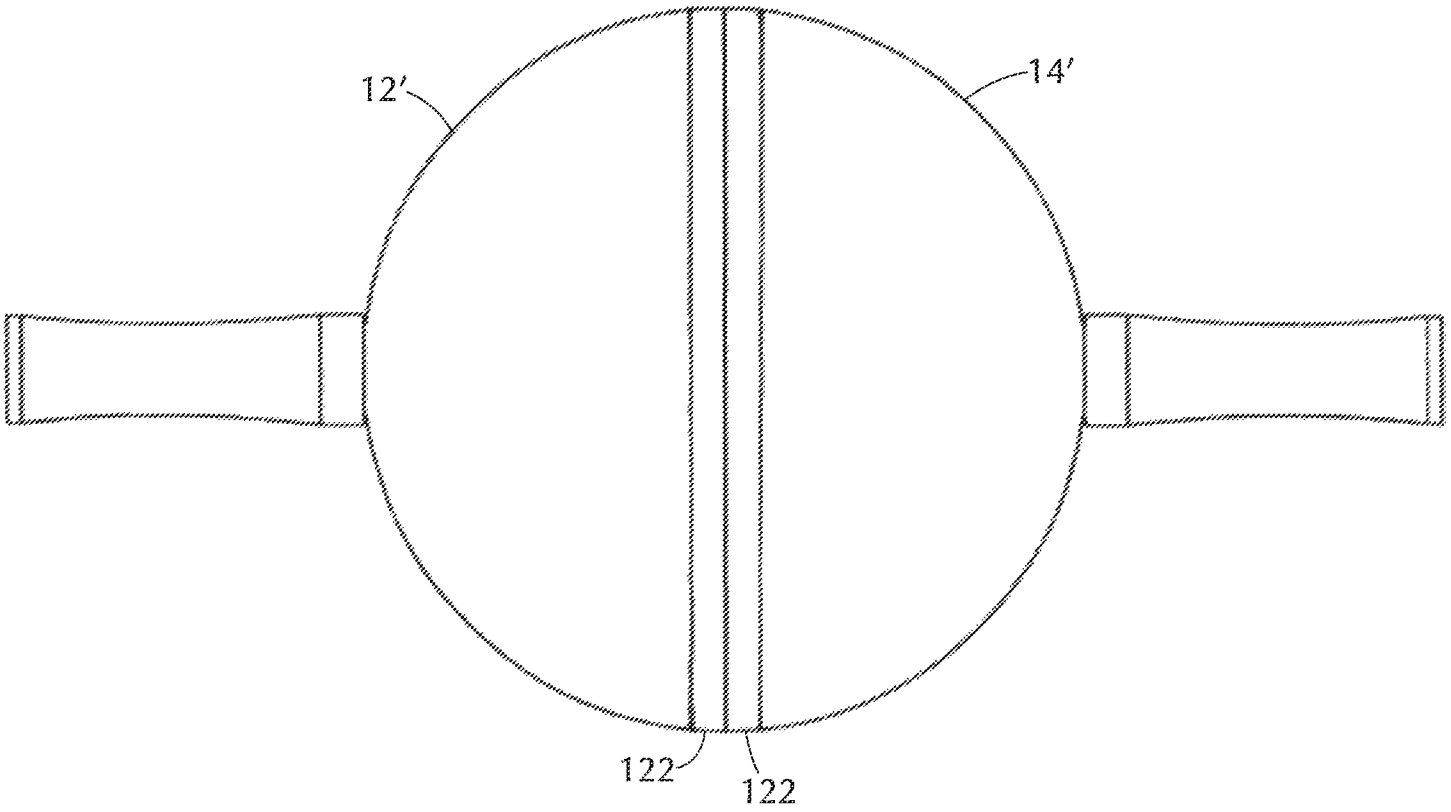
FIG. 29 is a side elevation view of an exercise device employing the additional preferred bodies.

Referring to FIG. 25, alternatively, the rod 34" of the exercise device 10 can have an internally threaded portion 112' and the various attachments 114' can have external threads 118' configured to connect to the internal threads of the rod 34". The inner ends 116' of the attachments 114' can be configured to project partially or wholly into the bore 30 of the bodies 12, 14 and to connect to the rod 34" disposed therein. For example, an overall length of the rod 34" can be less than twice the height H of each body 12, 14 such that the threaded portions 112' thereof are disposed entirely within the spherical assembly 50 described herein, and the attachments 114' can be configured for connection thereto within the body 12, 14.

As an alternative, the exercise device 10 can employ connection methods and means other than threads to releasably connect the various attachments 114, 114' to the support member 110, 110'. For example, the connection method can include clamps, screws, springs snaps, clasps, or other suitable mechanical, magnetic, or other suitable connection methods.

Referring to FIGS. 26-29, in an additional preferred embodiment, each hemispherical bodies 12', 14' of the exercise device preferably has an overall shape as described herein, including a substantially planar, circular face 22 having a center 24, and a substantially hemispherical dome 26 extending from the face 22, and the dome has an apex 28. However, the face and/or dome portions 22, 26 of each body 12', 14' can include an elastomeric ring 122 on an exterior thereof around the circumference of the dome adjacent to and/or abutting the face 22 to provide a cushion when rolling the exercise device 10 on a surface such as a floor.

An exterior surface 128 of the ring 122 is preferably contiguous (e.g., flush) with the exterior surface of the associated dome 26. The ring 122 can be disposed around the body, such as in a circumferential notch 124 adjacent to the face 22. Preferably the ring has an inner surface 126 which is substantially parallel to (and optionally substantially coplanar with) the face 22, and has an outer surface 128 which preferably substantially conforms to (e.g., is contiguous with) the shape of the dome, and/or optionally is substantially perpendicular to the face 22. The ring 122 can have a substantially square or rectilinear cross-section. Such ring 122 can provide a softer rolling surface when the exercise device is in the abdominal exercise configurations (see FIG. 29), and can provide additional traction when the disc is placed face-down as described herein.

Figure 30:
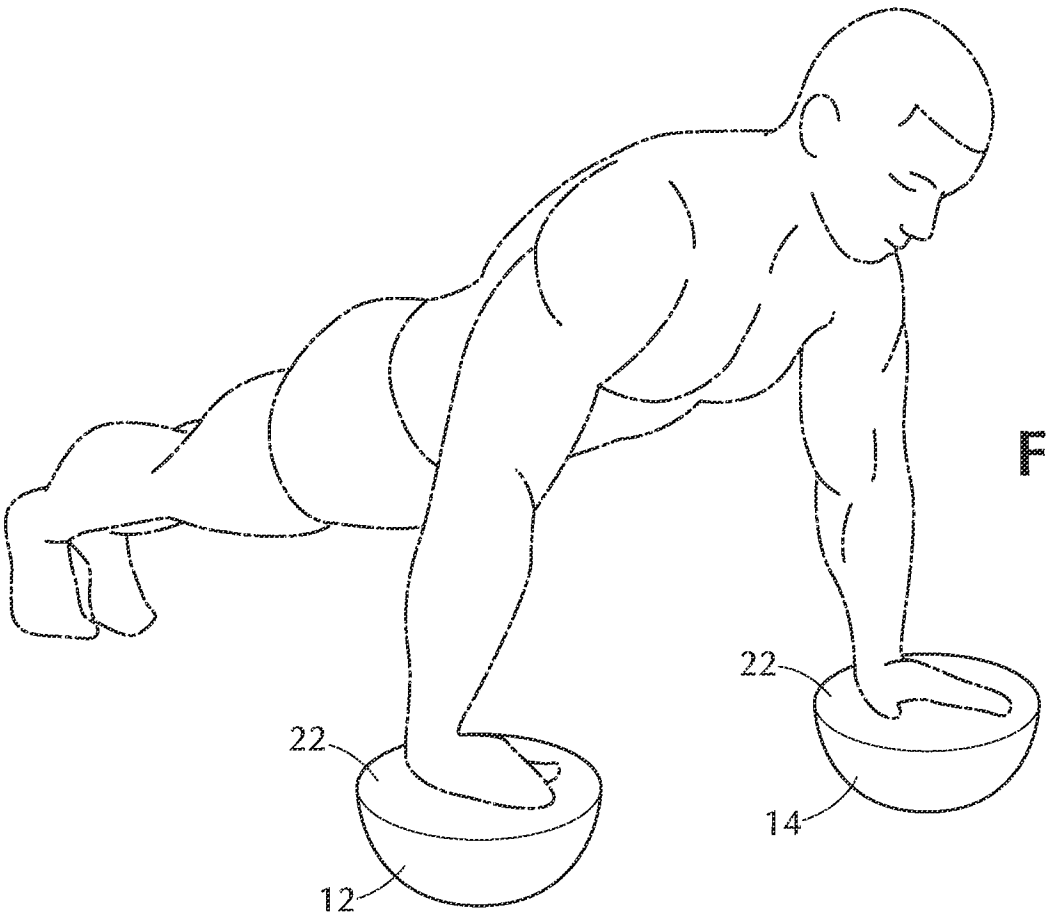
FIGS. 30 and 31 are depictions of standing uses of the exercise device in a disassembled configuration.
Figure 31:
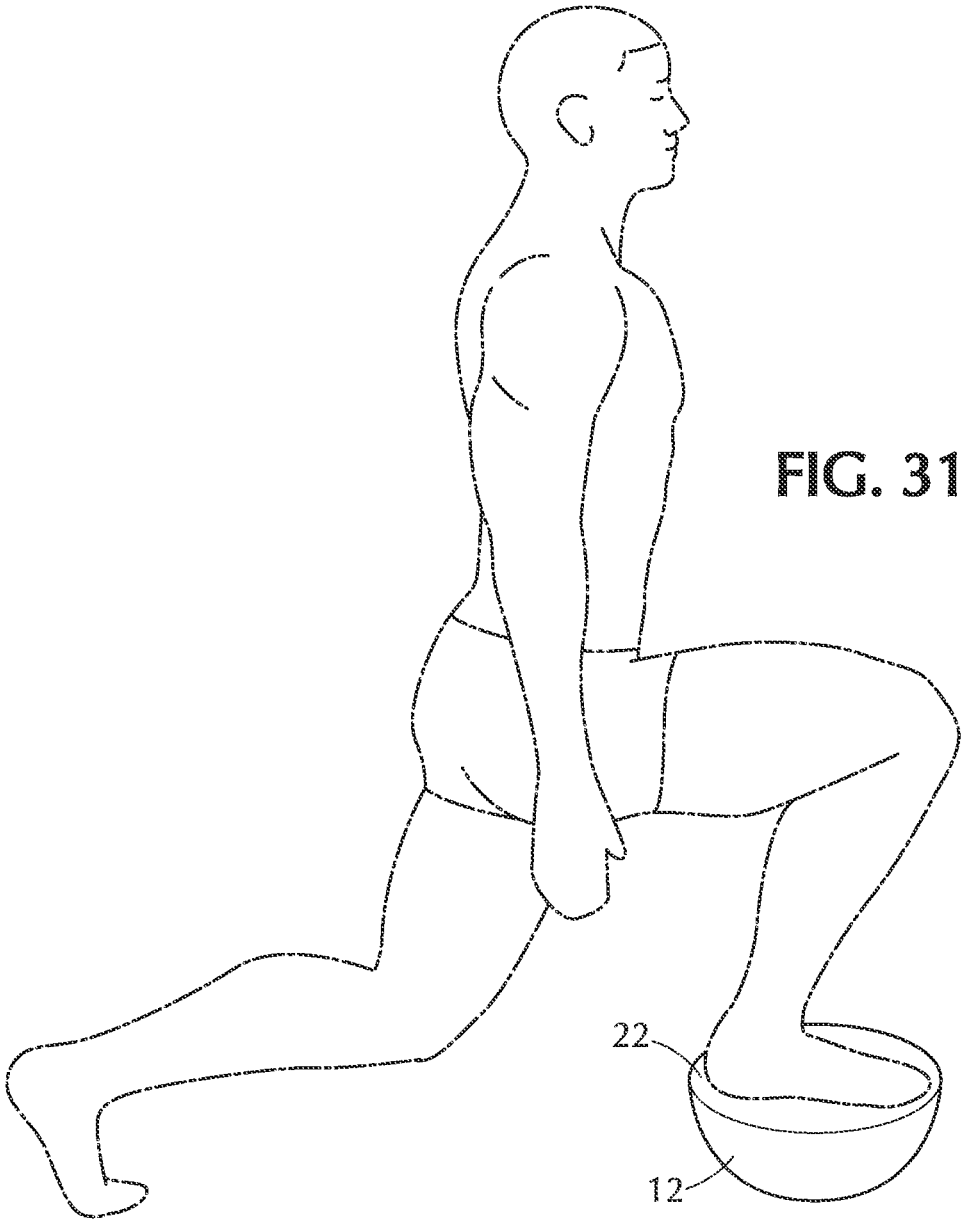
Figure 32:
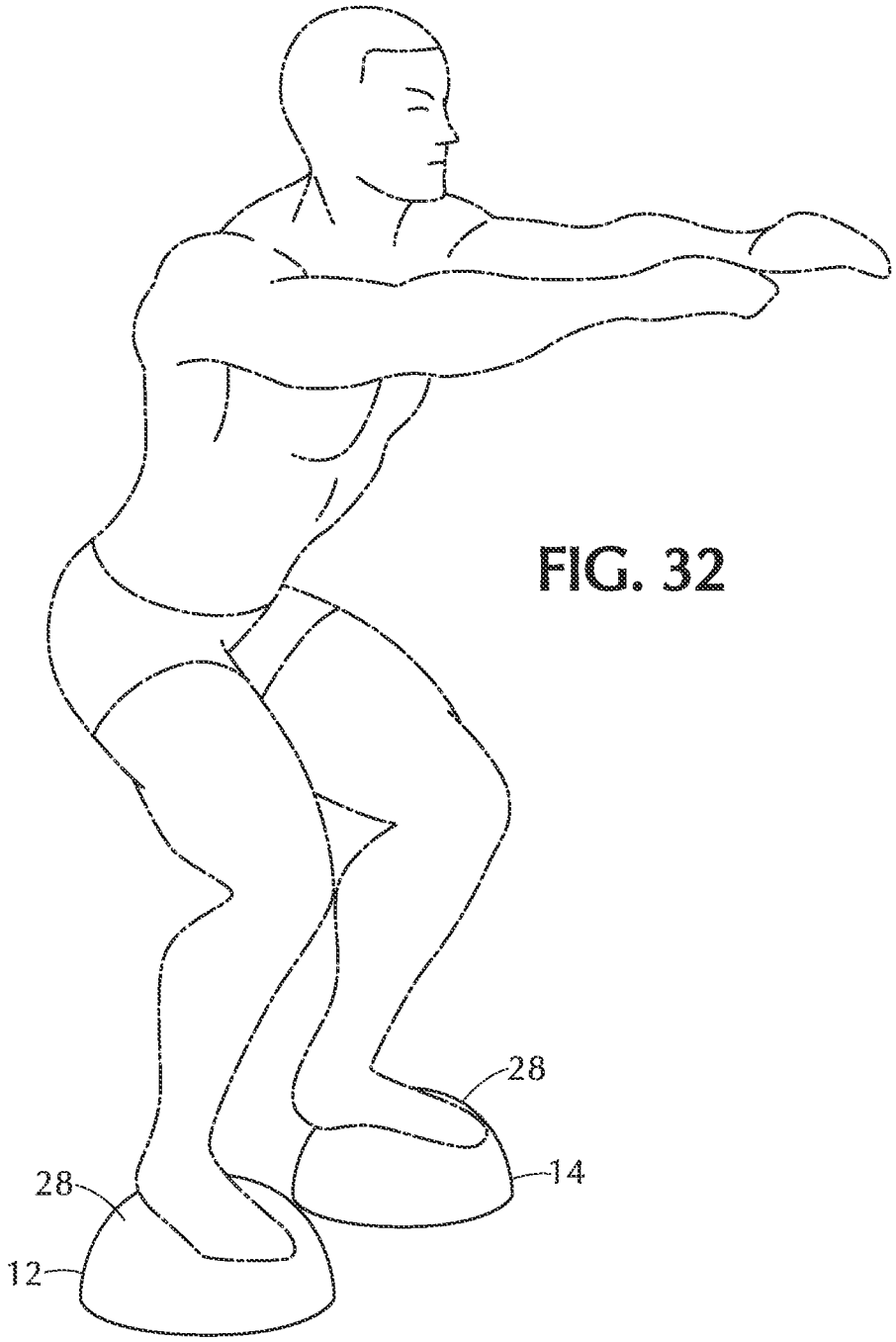
FIG. 32 is a depiction of prone uses of the exercise device in the disassembled configuration.

Referring to FIGS. 30-32, the bodies 12, 14 can be separated and used on a floor surface for many types of exercises, either together or individually, with the face 22 or the dome 26 contacting the surface. For example, referring to FIG. 30, one or both bodies 12, 14 can be placed with the face(s) 22 thereof contacting the surface, and the user can stand on the bodies and perform squat exercises. Referring to FIG. 31, one or both bodies 12, 14 can be placed with the dome(s) 26 contacting the surface, and the user can perform standing lunges by alternately stepping on and off of the bodies. Referring to FIG. 32, one or both bodies 12, 14 can be placed with the dome(s) 26 (or face(s) 22) thereof contacting the surface, and the user can use the bodies 12, 14 as push-up or plank supports. As describe herein, each body 12, 14 is configured to independently withstand a substantial adult human body weight or force placed anywhere thereon and in any orientation without substantial deformation, including when in the symmetrical spherical assembly 50, and when used separately in a face-down or face-up orientation.

It should be understood, of course, that the specific form of the invention herein illustrated and described is intended to be representative only, as certain changes may be made therein without departing from the clear teachings of the disclosure. Accordingly, reference should be made to the following appended claims in determining the scope of the claimed invention.

What is claimed is:

1. A exercise device, comprising:

a first body and a second body, each body being substantially hemispherical and substantially identical and having:

(a) a face which is substantially planar and substantially circular, and the face having a center;

(b) a dome extending from the face, the dome being substantially hemispherical and having an apex;

(c) an axis passing through the apex of the dome and the center of the face, and the axis being perpendicular to the face; and (d) a bore extending through the body from the face to the apex of the dome, and the bore being coaxial with the axis; and (e) each body being substantially rigid and being operable to support a substantial human weight applied to the face or the dome without substantial deformation;

a rod configured to be selectively received within the bore of each body, the rod having a longitudinal axis;

the exercise device having a first assembled configuration comprising:

(a) the face of the first body abutting the face of the second body, and the axis of the first body being substantially colinear with the axis of the second body, forming a substantially spherical assembly;

(b) the rod being received within the bores of the first and second bodies in the spherical assembly, the rod forming an axle for the spherical assembly and the spherical assembly being operable to directly rotate on the rod;

(c) first and second abdominal exercise handles connected to the rod closely adjacent to opposing sides of the spherical assembly;

(d) the rod in combination with the first and second abdominal exercise handles, serving to confine the first and second bodies in the spherical assembly by preventing substantial axial movement of each body relative to the longitudinal axis of the rod such that the first and second bodies are confined in the spherical assembly; and (e) the first abdominal exercise handle being operable to be disconnected from the rod, and upon disconnection of the first abdominal handle from the rod the bodies being removable from the rod for disassembly of the spherical assembly; and the exercise device having a disassembled configuration comprising: each body being separated from the rod; and each body being operable to be used as an exercise support in either a face-down or face-up orientation.

2. The exercise device of claim 1, further comprising:

each first and second abdominal exercise handle comprises a hand grip aligned substantially parallel to the longitudinal axis of the rod, in the assembled configuration, and each of the first and second abdominal exercise handles being operable to receive a substantial downward force thereon, perpendicular to the longitudinal axis of the rod; and the spherical assembly being operable to roll on a floor surface with the substantial downward force applied to the first and second abdominal exercise handles and with the spherical assembly rotating relative to the first and second hand grips.

3. The exercise device claim 1, wherein: each body is operable for rotation relative to the rod, independent of the other body.

4. The exercise device of claim 3, wherein:

after detachment of the first abdominal exercise handle from the rod, an assembly of the rod and second abdominal exercise handle is operable to be removed from the spherical assembly.

5. The exercise device of claim 4, wherein, in the first assembled configuration:

inner portions of the first and second abdominal exercise handles are disposed adjacent the apex of the first and second bodies on opposing sides of the associated bore.

6. The exercise device of claim 5, wherein, in the first assembled configuration:

the first abdominal exercise handle having a fully attached position on the rod; and in the fully attached position, the inner portions of the first and second abdominal exercise handles being configured to permit substantially free rotation of the first and second bodies relative to the rod.

7. The exercise device of claim 6, wherein:

the first and second abdominal exercise handles are operable for threaded connection to the rod.

8. The exercise device of claim 1, further comprising:

the exercise device having a second assembled configuration wherein first and second end caps are connected to the rod, on opposing sides of the spherical assembly; and at least one of the first and second end caps being operable to be disconnected from the rod to permit removal of the bodies from the rod for disassembly of the spherical assembly.

9. The exercise device of claim 8, further comprising:

the exercise device having a third assembled configuration wherein a first end cap and a kettlebell handle are mounted to the rod, on opposing sides of the spherical assembly; and the kettlebell handle having a hand grip aligned substantially perpendicular to the longitudinal axis of the rod.

10. The exercise device of claim 9, wherein:

the first end of the rod passes through an opening in a base of the kettlebell handle and the base is disposed between the first end cap and one of the first and second bodies of the spherical assembly.

11. The exercise device of claim 1, wherein:

in the disassembled configuration, each body being operable to be used as an the exercise support in either the face-down or the face-up orientation for exercises selected from the group consisting of squats, standing lunge, and pushups.

12. The exercise device of claim 1, wherein:

in the first assembled configuration:

the first and second bodies are independently mounted on the rod; and the rod is closely received within the bore of each body and is configured to rotatably support each body in a stable manner.

13. An exercise device, comprising:

a first body and a second body, each body being substantially hemispherical and having:

(a) a face which is substantially planar and substantially circular, and the face having a center;

(b) a dome extending from the face, the dome being substantially hemispherical and having an apex;

(c) an axis passing through the apex of the dome and the center of the face, and the axis being perpendicular to the face; and (d) a bore extending through the body from the face to the apex of the dome, and the bore being coaxial with the axis; and (e) each body being substantially rigid and being operable to support a substantial human weight applied to the face or the dome without substantial deformation;

a rod configured to be selectively received within the bore of each body, the rod having a longitudinal axis;

the exercise device having an assembled configuration comprising:

(a) the face of the first body abutting the face of the second body, and the axis of the first body being substantially colinear with the axis of the second body, forming a substantially spherical assembly;

(b) the rod being received within the bores of the first and second bodies in the spherical assembly, and the rod forming an axle for the spherical assembly;

(c) means to prevent substantial axial movement of each body relative to the longitudinal axis of the rod such that the first and second bodies are confined in the spherical assembly;

(d) the means to prevent substantial axial movement of the bodies including first and second stops connected to the rod closely adjacent opposing sides of the spherical assembly; and (e) at least one of the first and second stops being operable to be disconnected from the rod to permit removal of the bodies from the rod for disassembly of the spherical assembly; and the exercise device having a disassembled configuration comprising:

each body being separated from the rod;

each body being operable to be used as an exercise support in either a face-down or face-up orientation;

in the assembled configuration, the first and second stops comprise first and second abdominal exercise handles connected to the rod, on opposing sides of the spherical assembly;

each first and second abdominal exercise handle comprises a hand grip aligned substantially parallel to the longitudinal axis of the rod, in the assembled configuration, and each of the first and second abdominal exercise handles being operable to receive a substantial downward force thereon, perpendicular to the longitudinal axis of the rod;

the spherical assembly being operable to roll on a floor surface with the substantial downward force applied to the first and second abdominal exercise handles and with the spherical assembly rotating relative to the first and second hand grips;

the first and second abdominal exercise handles are fixed relative to the rod;

each body is operable for rotation relative to the rod; and each body is operable for rotation relative to the rod, independent of the other body.

14. The exercise device of claim 13, wherein:

the first abdominal exercise handle is detachable from the rod; and after detachment of the first abdominal exercise handle from the rod, an assembly of the rod and second abdominal exercise handle is operable to be removed from the spherical assembly.

15. The exercise device of claim 14, wherein, in the assembled configuration:

the means to prevent substantial axial movement of each body relative to the rod comprises inner portions of the first and second abdominal exercise handles which are disposed adjacent the apex of the first and second bodies on opposing sides of the associated bore.

16. The exercise device of claim 15, wherein, in the assembled configuration:

the first abdominal exercise handle having a fully attached position on the rod; and in the fully attached position, the inner portions of the first and second abdominal exercise handles being configured to permit substantially free rotation of the first and second bodies relative to the rod.

17. The exercise device of claim 16, wherein:

the first and second abdominal exercise handles are operable for threaded connection to the rod.

18. The exercise device of claim 13, wherein:

the first and second bodies are substantially identical.

19. An exercise device, comprising:

a first body and a second body, each body being substantially hemispherical and having:

(a) a face which is substantially planar and substantially circular, and the face having a center;

(b) a dome extending from the face, the dome being substantially hemispherical and having an apex;

(c) an axis passing through the apex of the dome and the center of the face, and the axis being perpendicular to the face; and (d) a bore extending through the body from the face to the apex of the dome, and the bore being coaxial with the axis; and (e) each body being substantially rigid and being operable to support a substantial human weight applied to the face or the dome without substantial deformation;

a rod configured to be selectively received within the bore of each body, the rod having a longitudinal axis;

the exercise device having an assembled configuration comprising:

(a) the face of the first body abutting the face of the second body, and the axis of the first body being substantially colinear with the axis of the second body, forming a substantially spherical assembly;

(b) the rod being received within the bores of the first and second bodies in the spherical assembly, and the rod forming an axle for the spherical assembly;

(c) means to prevent substantial axial movement of each body relative to the longitudinal axis of the rod such that the first and second bodies are confined in the spherical assembly;

(d) the means to prevent substantial axial movement of the bodies including first and second stops connected to the rod closely adjacent opposing sides of the spherical assembly;

(e) each body is operable for rotation relative to the rod, independent of the other body; and (f) at least one of the first and second stops being operable to be disconnected from the rod to permit removal of the bodies from the rod for disassembly of the spherical assembly;

the exercise device having a disassembled configuration comprising:

each body being separated from the rod; and each body being operable to be used as an exercise support in either a face-down or face-up orientation.

20. An exercise device, comprising:

a first body and a second body, each body being substantially hemispherical and substantially identical and having:

(a) a face which is substantially planar and substantially circular, and the face having a center;

(b) a dome extending from the face, the dome being substantially hemispherical and having an apex;

(c) an axis passing through the apex of the dome and the center of the face, and the axis being perpendicular to the face; and (d) a bore extending through the body from the face to the apex of the dome, and the bore being coaxial with the axis; and (e) each body being substantially rigid and being operable to support a substantial human weight applied to the face or the dome without substantial deformation;

a rod configured to be selectively received within the bore of each body, the rod having a longitudinal axis;

the exercise device having an assembled configuration comprising:

(a) the face of the first body abutting the face of the second body, and the axis of the first body being substantially colinear with the axis of the second body, forming a substantially spherical assembly;

(b) the rod being received within the bores of the first and second bodies in the spherical assembly, and the rod forming an axle for the spherical assembly;

(c) means to prevent substantial axial movement of each body relative to the longitudinal axis of the rod such that the first and second bodies are confined in the spherical assembly;

(d) the means to prevent substantial axial movement of the bodies including first and second stops connected to the rod closely adjacent opposing sides of the spherical assembly; and (e) at least one of the first and second stops being operable to be disconnected from the rod to permit removal of the bodies from the rod for disassembly of the spherical assembly; and the exercise device having a disassembled configuration comprising:

each body being separated from the rod;

each body being operable to be used as an exercise support in either a face-down or face-up orientation;

a kettlebell handle mounted to a first end of the rod, the kettlebell handle having a hand grip aligned substantially perpendicular to the longitudinal axis of the rod, in the assembled configuration; and the first end of the rod passes through an opening in a base of the kettlebell handle and the base is disposed between the first stop and one of the first and second bodies of the spherical assembly.

* * * * *